US007277662B2

(12) United States Patent
Sawai et al.

(10) Patent No.: US 7,277,662 B2
(45) Date of Patent: Oct. 2, 2007

(54) BELT MEMBER, BELT DRIVING UNIT, AND IMAGE FORMING APPARATUS

(75) Inventors: Yuuji Sawai, Kanagawa (JP); Hideaki Mochimaru, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 281 days.

(21) Appl. No.: 11/119,854

(22) Filed: May 3, 2005

(65) Prior Publication Data

US 2005/0286930 A1 Dec. 29, 2005

(30) Foreign Application Priority Data

Jun. 25, 2004 (JP) ..... 2004-187393

(51) Int. Cl.
*G03G 15/00* (2006.01)

(52) U.S. Cl. ..... 399/167

(58) Field of Classification Search ..... 399/159, 399/162, 163, 164, 165, 167
See application file for complete search history.

(56) References Cited

U.S. PATENT DOCUMENTS

| | | | | |
|---|---|---|---|---|
| 5,574,527 | A * | 11/1996 | Folkins | 399/9 |
| 6,369,842 | B1 * | 4/2002 | Abramsohn | 347/116 |
| 6,611,672 | B2 | 8/2003 | Aoki et al. | |
| 6,618,565 | B2 | 9/2003 | Tamiya et al. | |
| 6,697,595 | B2 | 2/2004 | Kawagoe et al. | |
| 6,741,821 | B2 | 5/2004 | Sugino et al. | |
| 6,768,892 | B2 | 7/2004 | Sawai | |
| 6,785,500 | B2 | 8/2004 | Takahashi et al. | |
| 6,823,149 | B2 | 11/2004 | Yoshikawa et al. | |
| 6,829,450 | B2 | 12/2004 | Tamiya et al. | |
| 6,885,842 | B2 | 4/2005 | Sawai | |
| 6,909,516 | B1 * | 6/2005 | Hoover | 356/615 |
| 7,133,627 | B2 * | 11/2006 | Nishizaki | 399/167 |
| 2003/0118359 | A1 | 6/2003 | Ogiyama et al. | |
| 2003/0219287 | A1 | 11/2003 | Ogiyama et al. | |
| 2004/0101332 | A1 | 5/2004 | Sohmiya et al. | |
| 2004/0109709 | A1 | 6/2004 | Ishibashi et al. | |
| 2004/0131398 | A1 | 7/2004 | Omata et al. | |
| 2004/0136760 | A1 | 7/2004 | Yoshida et al. | |
| 2005/0013636 | A1 | 1/2005 | Sawai et al. | |
| 2005/0286930 | A1 | 12/2005 | Sawai et al. | |

FOREIGN PATENT DOCUMENTS

| | | |
|---|---|---|
| JP | 9-114348 | 5/1997 |
| JP | 11-15297 | 1/1999 |

OTHER PUBLICATIONS

U.S. Appl. No. 11/608,599, filed Dec. 8, 2006, Sawai.

* cited by examiner

*Primary Examiner*—Hoan Tran
(74) *Attorney, Agent, or Firm*—Oblon, Spivak, McClelland, Maier & Neustadt, P.C.

(57) ABSTRACT

A belt member is formed in an annular shape, which enables endless circulation of the belt member, and includes a belt base; a mark that is formed with a light reflective material; and a protection layer that is formed with a translucent material. The protection layer covers the mark, and the mark and the protection layer are arranged on a surface of the belt member on an inner side of the annular shape.

17 Claims, 17 Drawing Sheets

BELT MEMBER, BELT DRIVING UNIT, AND IMAGE FORMING APPARATUS

CROSS-REFERENCE TO RELATED APPLICATIONS

The present document incorporates by reference the entire contents of Japanese priority document, 2004-187393 filed in Japan on Jun. 25, 2004.

BACKGROUND OF THE INVENTION

1) Field of the Invention

The present invention relates to a belt member, a belt driving unit, and an image forming apparatus.

2) Description of the Related Art

Conventionally, annular belt members, which are endlessly moved while being stretched by a plurality of stretch members, have been used in various fields. For example, in an electrophotographic type image forming apparatus, an annular belt member is used as a latent image carrier, such as a photosensitive element, or an intermediate transfer unit. In such electrophotographic type image forming apparatus, an image is formed in a following process. First, a latent image carrier is exposed, and an electrostatic latent image of a scanned image is formed on the latent image carrier. To the electrostatic latent image, a developer, such as a toner negatively-charged or negatively-charged, is applied. Thus, a toner image is formed. The toner image is then transferred onto a recording medium, such as a transfer sheet, directly from the latent image carrier, or through an intermediate transfer unit. The toner image transferred is then fixed to the recording medium by a process, such as heating. The annular belt member is used as the latent image carrier or the intermediate transfer unit that are used in such an image forming process in the image forming apparatus.

In some of the image forming apparatuses, timing for various actions such as image forming and sheet feeding, are determined based a reference mark that is provided on the annular belt. Such timing is determined by detecting the reference mark. The reference mark is provided at a predetermined position in a direction of circulation of the annular belt. For example, in an image forming apparatus disclosed in Japanese Patent Application Laid-open No. H11-15297, a reflective reference mark is provided at a predetermined position in an intermediate transfer belt, and is detected by a reflective photosensor. The image forming apparatus determines exposure timing for a photosensitive element based on timing at which the reflective reference mark is detected.

In another image forming apparatus disclosed in, for example, Japanese Patent Application Laid-open No. H9-114348, more than one mark is provided at predetermined intervals on a belt member in a direction of circulation, and a driving speed of the belt member is controlled based on time intervals at which the marks are detected. A reflective photosensor in such image forming apparatus detects light reflective marks, and based on fluctuations in time intervals at which the light reflective marks are detected, fluctuations in the running speed are detected. When the fluctuations are detected in the running speed, the running speed is adjusted to be a target speed. Thus, fluctuation of the running speed is suppressed.

However, the reference marks and the marks (hereinafter generally, "mark") are gradually stained as the belt member is driven by a belt driving unit. If the mark is stained so badly that a sensor cannot detect the mark, various malfunctions may occur in the image forming apparatus. The malfunctions include inappropriate timing determination for forming an image and erroneous detection of the fluctuation in the running speed. Such a problem is more likely to occur in an image forming apparatus that use a colored developer, such as a color toner, due to adhesion of the colored developer.

The inventors of the present invention have been developing a novel belt member that has a protection layer for the mark. The protection layer is translucent, and is provided on the mark to protect the mark. Generally, surface treatment with chemicals or by polishing is required to provide a good light reflection property to the mark. By the surface treatment, the mark becomes more likely to let stains adhere thereon. The protection layer in the belt member that is under development by the inventors does not require the surface processing. Therefore, adhesion of stain over the mark is prevented, thereby preventing occurrence of the malfunctions described above that are originated from the stain on the mark.

However, the protection layer is gradually damaged with scratches being made with use of the belt member. As the protection layer is damaged, a translucence of the protection layer is degraded. As a result, the mark cannot be detected properly. Specifically, the belt driving unit that drives a belt member is provided with a cleaning member that cleans a stain of toner adhered to a surface of the belt member. The stain is scraped off by sliding the cleaning member, such as a plate scraper and a brush, on the surface. While repeating such a process by the cleaning member, the protection layer is gradually damaged.

SUMMARY OF THE INVENTION

It is an object of the present invention to solve at least the above problems in the conventional technology.

A belt member according to one aspect of the present invention is formed in an annular shape that enables endless circulation of the belt member, and includes a belt base; a mark that is formed with a light reflective material; and a protection layer that is formed with a translucent material. The protection layer covers the mark, and the mark and the protection layer are arranged on a surface of the belt member, the surface on an inner side of the annular shape.

A belt driving unit according to another aspect of the present invention includes a belt member according to the above aspects; a plurality of stretch members that stretch the belt member while supporting the belt member from the inner side; a driving unit that drives the belt member to make the endless circulation with drive power of a drive source; a detection unit that detects the marks; and a control unit that controls driving of the drive source based on a result of detection by the detection unit.

An image forming apparatus according to still another aspect of the present invention includes a latent image carrier that carries a latent image; a developing unit that develops the latent image into a visible image; a belt driving unit according to the above aspects; and a transfer unit that transfers the visible image from the latent image carrier to the belt member at a position at which the latent image carrier and the belt member contact with each other.

An image forming apparatus according to still another aspect of the present invention includes a visible-image forming unit that forms a visible image on a recording medium that is formed in a sheet; and a belt driving unit according to the above aspects that conveys the recording medium. The belt driving unit conveys the recording medium by the endless circulation while holding the recording medium on a surface on an outer side of the annular shape of the belt member.

An image forming apparatus according to still another aspect of the present invention includes a latent image carrier that is an annular belt, and that carries a latent image; a belt driving unit according to the above aspect that drives the latent image carrier to make an endless circulation; a developing unit that develops the latent image into an visible image; and a transfer unit that transfers the visible image to a recording medium.

The other objects, features, and advantages of the present invention are specifically set forth in or will become apparent from the following detailed description of the invention when read in conjunction with the accompanying drawings.

DETAILED DESCRIPTION

Exemplary embodiments according to the present invention will be explained in detail below with reference to the accompanying drawings.

A tandem type color laser printer (hereinafter, simply "printer") will be described as an embodiment of an image forming apparatus according to the present invention.

Figure 1:
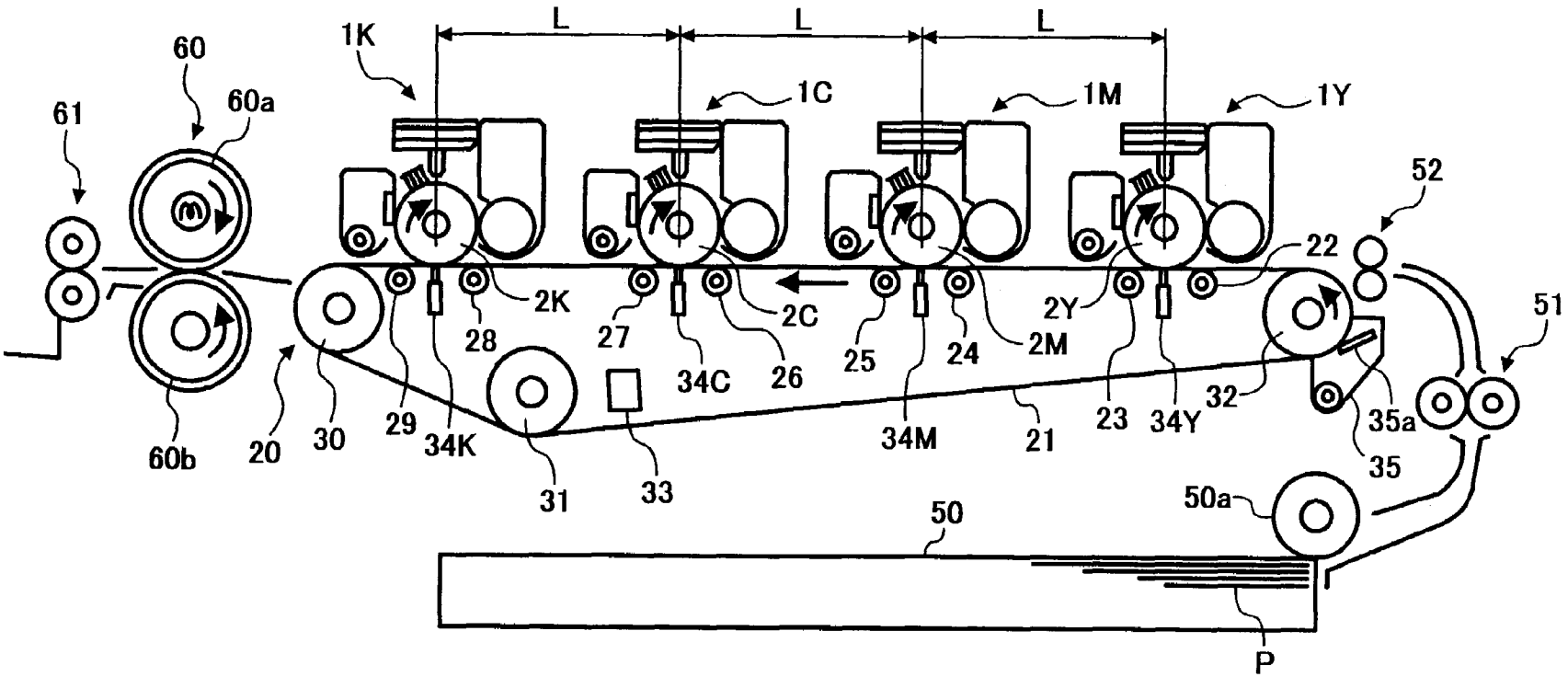
FIG. 1 is a schematic of a printer according to an embodiment of the present invention.

FIG. 1 is a schematic of a printer according to the embodiment. The printer includes four sets of process units 1Y, 1M, 1C, and 1K for forming images of individual colors of yellow (Y), magenta (M), cyan (C) and black (K). The printer also includes a transfer unit 20, a sheet feeding cassette 50, a pair of feed rollers 51, a pair of resisting rollers 52, a fixing unit 60, and a pair of sheet discharge rollers 61. The characters, Y, M, C, and K, affixed to individual symbols respectively indicate members for yellow, magenta, cyan, and black.

The process units 1Y, 1M, 1C, and 1K respectively have drum-like photosensitive elements 2Y, 2M, 2C, and 2K, which are latent image carriers that hold latent images. Each of those photosensitive elements 2Y, 2M, 2C, and 2K is rotated clockwise in FIG. 1 by a driving unit (not shown).

Figure 2:
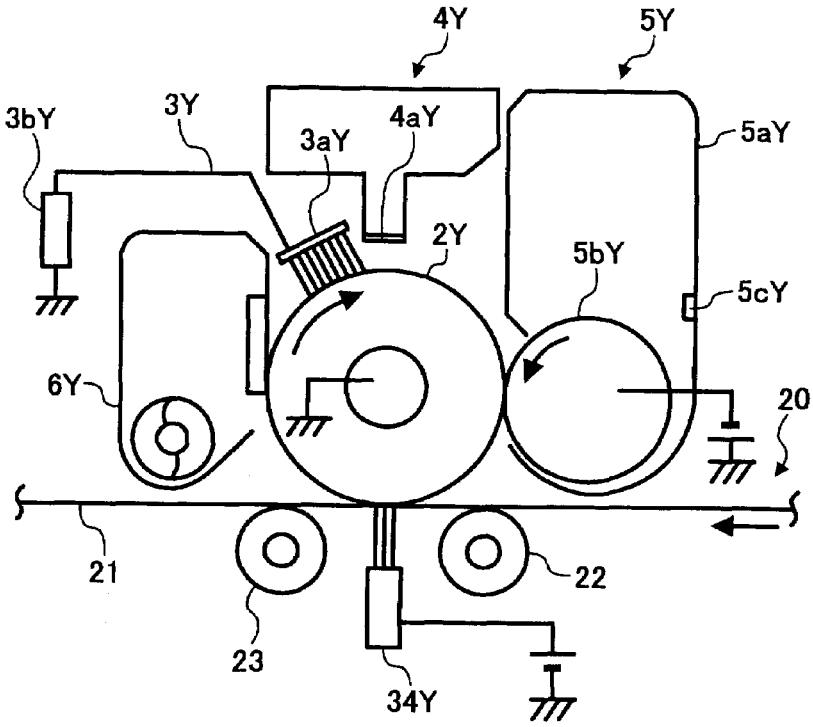
FIG. 2 is an enlarged-view of a process unit for Y and a part of a transfer unit of the printer shown in FIG. 1.

FIG. 2 is an enlarged view of the process unit 1Y among four units of the process units 1Y, 1M, 1C, and 1K and a part of a part of the transfer unit 20. Because each of the process units 1Y, 1M, 1C, and 1K has an identical structure except for the color of the toner to be used therein, explanations for the process units 1M, 1C, and 1K are omitted. As shown in FIG. 2, the process unit 1Y includes a uniform charger 3Y, an optical writing unit 4Y, a developing device 5Y, a drum cleaning unit 6Y, and a deelectrifying unit (not shown) in addition to the photosensitive element 2Y.

The uniform charger 3Y includes a charge brush 3*a*Y that contacts the outer surface of the photosensitive element 2Y that is rotated clockwise in FIG. 2, and a charge bias power source 3*b*Y that applies a charge bias to the charge brush 3*a*Y. While being applied with an alternating current (AC) charge bias by the charge bias power source 3*b*Y, the charge brush 3*a*Y causes its edge to slide on the photosensitive element 2Y. The slide contact causes discharge from the edge of the charge brush 3*a*Y toward the photosensitive element 2Y, so that the photosensitive element 2Y is uniformly charged with a predetermined polarity, for example, negative. As the uniform charger 3Y, a charge roller to which a charge bias is applied may be used in such a manner that the charge roller is slid on the front side of the photosensitive element 2Y, instead of the charge brush type. Moreover, a corotron charger that applies a charge to the photosensitive element 2Y without making a contact with the photosensitive element 2Y may be used. In the optical writing unit 4Y, a light emitting diode (LED) array 4*a*Y having a plurality of LEDs is laid opposite to the front side of the photosensitive element 2Y. As the LED array 4*a*Y is driven based on image information sent from a personal computer (not shown), the front side of the photosensitive element 2Y uniformly charged by the uniform charger 3Y is optically scanned. The optical scanning forms an electrostatic latent image for Y on the front side. The photosensitive element 2Y has a photoconductive layer of an organic photoconductive material provided on the front side of an aluminum cylinder with a diameter of 25 millimeters (mm) to 100 mm. A photoconductive layer of amorphous silicon can be provided in place of the photoconductive layer of an organic photoconductive material.

The developing device 5Y includes a developer case 5*a*Y, a developing roll 5*b*Y laid in such a manner that the developing roll 5*b*Y is partly exposed through an opening in the developer case 5*a*Y, and a toner density sensor (hereinafter, "T sensor") 5*c*Y. The developer case 5*a*Y contains a developer containing a magnetic carrier and a negative-charged Y toner. The developer is supplied to the developing roll 5*b*Y as a developer holding member while being stirred by a feed screw (not shown) to encourage frictional charging of the Y toner. The developing roll 5*b*Y includes a developer sleeve configured by a non-magnetic member, and a magnet roller (not shown) fixed inside so as not to be moved collaterally by the sleeve. The magnetic force generated by the magnet roller causes the developer to be held on the front side of the sleeve. The developer sleeve is rotated counterclockwise in FIG. 2 by a driving unit (not shown) to feed the developer held on the front side to a developing position facing the photosensitive element 2Y.

The T sensor 5*c*Y including a magnetic permeability sensor is attached to the side plate of the developer case 5*a*Y, and outputs a voltage of which a value corresponds to the magnetic permeability of the developer to be fed by the feed screw. As the magnetic permeability of the developer represents a proper correlation with the toner density of the developer, the T sensor 5*c*Y outputs a voltage of which a value corresponds to the toner density. The value of the output voltage is sent to a controller (not shown). The controller includes a memory unit, such as a random access memory (RAM), that stores Vtref data for Y, which is the target value for the output voltage of the T sensor 5*c*Y, and Vtref data for M, C, and K that are target values for the output voltages of T sensors mounted in the other developing devices. The developing device 5Y compares the value of the output voltage of the T sensor 5*c*Y with Vtref for Y, and drives a Y toner supply unit coupled to a Y toner cartridge (not shown) by a time corresponding to the comparison result. As a result, the Y toner in the Y toner cartridge is supplied to the developing device 5Y. As driving of the Y toner supply unit is controlled (toner supply control), the adequate amount of Y toner is supplied to the developer of which the Y toner density has dropped as a result of the development, so that the toner density of the developer in the developing device 5Y is maintained within a predetermined range. In a similar manner, a toner supply control is performed for the other units of the developing devices 5M, 5C, and 5K. M, C, and K toner images are likewise developed on the photosensitive elements 2M, 2C, and 2K.

The transfer unit 20 causes the sheet feeding belt 21 as the belt member to move in an endless-belt manner with the rotation of a drive roller (not shown) that is one of a plurality of stretch rollers 22 and 23, or the like, while being stretched by the stretch rollers. The sheet feeding belt 21 that is moved in an endless-belt manner this way abuts on the photosensitive element 2Y and forms a transfer nip for Y below the photosensitive element 2Y. The tip of a transfer brush 34Y for Y to which a transfer bias with the opposite polarity to that of the toner is applied contacts the back side of the sheet feeding belt 21 at the transfer nip. The bias application forms a transfer electric field at the transfer nip between the transfer brush 34Y and the photosensitive element 2Y. The sheet feeding belt 21 moves in an endless-belt manner while holding a transfer sheet (not shown) on the front side at a predetermined timing. When the transfer sheet is tucked in the transfer nip for Y, the Y toner image is transferred from the photosensitive element 2Y to the transfer sheet by the action of the transfer electric field or the nip pressure. M, C, and K toner images are transferred, one on another, on the transfer sheet from the photosensitive elements in the other process units (1M, 1C, and 1K) in the same manner.

A transfer residual toner that has not been transferred to the transfer sheet at the transfer nip is adhered to the front side of the photosensitive element 2Y after the transfer nip for Y has passed. The transfer residual toner image is cleaned off the front side of the photosensitive element 2Y by the drum cleaning unit 6Y. The residual charges on the cleaned front side of the photosensitive element 2Y are deelectrified by a deelectrifying unit (not shown), after which the front side of the photosensitive element 2Y is uniformly charged by the uniform charger 3Y.

The transfer unit 20 is laid under each process unit 1Y, 1M, 1C, 1K in FIG. 1. The transfer unit 20 includes the annular sheet feeding belt 21, and stretch rollers 22 to 32 that stretch the sheet feeding belt 21. The transfer unit 20 further includes a mark detection sensor 33 as a mark detection unit. The mark detection sensor 33 includes a reflective photosensor, and four transfer brushes 34Y, 34M, 34C, and 34K inside the loop of the sheet feeding belt 21. Among the stretch rollers, the stretch roller 32 is rotated counterclockwise in FIG. 1 by the driving unit (not shown) to serve as a drive roller that moves the sheet feeding belt 21 in an endless-belt manner counterclockwise in FIG. 1. A belt cleaning unit 35 abuts on that portion of the sheet feeding belt 21 on which the drive roller 32 rolls, from the front side of the belt. The belt cleaning unit 35 scrapes off and removes the toner adhered to the front side of the sheet feeding belt 21 with a cleaning blade 35*a* abutting on the front side of the belt.

The sheet feeding belt 21 is a high electric-resistance belt member with a volume resistivity and a surface resistivity respectively controlled to $10^{10}$ ohm centimeter (Ωcm) to $10^{12}$ Ωcm and $10^{12}$ Ω/□ to $10^{14}$ Ω/□. The sheet feeding belt 21 is moved in an endless-belt manner rotated counterclockwise in FIG. 1 by the rotation of the drive roller 32 while being stretched by the stretch rollers.

The transfer unit 20 as a belt driving unit is laid out, so that the top stretch side of the sheet feeding belt 21, which moves in an endless-belt manner this way, abuts on the photosensitive elements 2Y, 2M, 2C, and 2K of the process units (1Y, 1M, 1C, and 1K). The abutment forms four transfer nips for Y, M, C, and K on which the photosensitive elements (2Y, 2M, 2C, and 2K) abut.

The four transfer brushes 34Y, 34M, 34C, and 34K are laid out, so that the tips of the brushes abut on the back side of the belt at the transfer nips for Y, M, C, and K inside the loop of the sheet feeding belt 21. A transfer bias with the opposite polarity to that of the toners is applied to the transfer brushes 34Y, 34M, 34C, and 34K by transfer power sources (not shown). Accordingly, a transfer electric field is formed at each transfer nip between the transfer brushes 34Y, 34M, 34C, 34K and the photosensitive element 2Y, 2M, 2C, 2K. While the transfer brushes 34Y, 34M, 34C, and 34K are provided as the transfer bias members in the printer, transfer rollers can be also used instead of the transfer brushes.

The sheet feeding cassette 50 is disposed under the transfer unit 20. The sheet feeding cassette 50 contains a pile of transfer sheets P as a recording medium, With a sheet feed roller 50*a* pressing against a transfer sheet P positioned on top of the pile of the transfer sheet P. The sheet feed roller 50*a* is rotated at a given timing to feed the transfer sheet P on top to a sheet feeding path. The pair of feed rollers 51 and the pair of resisting rollers 52 are provided in order in the sheet feeding path, so that the transfer sheet P fed to the sheet feeding path is conveyed, while being tucked between each pair of rollers. When the pair of resisting rollers 52 tuck the tip side of the transfer sheet P between rollers, the roller pair stops driving the rollers. The driving of the rollers is then restarted at such timing as to synchronize the transfer sheet P with each color toner image formed on the photosensitive element of each process unit 1Y, 1M, 1C, 1K, feeding the transfer sheet P toward the transfer unit 20.

The transfer sheet P fed out is conveyed leftward from the right-hand side in FIG. 1 while being held at the top stretch side of the sheet feeding belt 21, and passes the transfer nips for Y, M, C, and K in order. The Y, M, C, K toner images on the photosensitive elements 2Y, 2M, 2C, and 2K are transferred and superimposed one on another, on the upper surface in FIG. 1 at the transfer nips. The overlapped transfer forms a full color image on the transfer sheet P.

The transfer sheet P with a full color image thus formed thereon comes to a position at which the stretch roller 30 rolls on the sheet feeding belt 21, as the sheet feeding belt 21 moves in an endless-belt manner. At the roll-on-belt position, the stretch roller 30 rolls on the sheet feeding belt 21 at such a sharp contact angle as to nearly reverse the endless-belt movement direction of the sheet feeding belt 21. The transfer sheet P held on the sheet feeding belt 21 cannot follow up such a swift change in a direction in which the belt's moving direction, and is separated from the sheet feeding belt 21. The transfer sheet P is then given to the fixing unit 60.

Before the sheet feeding belt 21 that has given the transfer sheet P to the fixing unit 60 at the roll-on-belt position of the stretch roller 30 enters each transfer nip again according to the endless-belt movement, the sheet feeding belt 21 comes to the roll-on-belt position of the drive roller 32. At the roll-on-belt position, the belt cleaning unit 35 causes the cleaning blade 35*a* to abut on the front side of the sheet feeding belt 21. The abutment removes by scraping the toners adhered to the front side of the sheet feeding belt 21 at each transfer nip.

The fixing unit 60 rolls both of a fixing roller 60*a*, which encloses a heat generating source, such as a halogen lamp, and a press roller 60*b* so that the rollers move on the surface in the same direction at a fixing nip while forming the fixing nip by abutment of both rollers on each other. The transfer sheet P given to the fixing unit 60 from the sheet feeding belt 21 is tucked in the fixing nip, and is conveyed toward the sheet discharge roller pair 61. The fixing roller 60*a* heats the toner transferred side of the transfer sheet P. Heating softens the toner of the full color image, and fixes the toner on the toner transfer surface.

The transfer sheet P having passed the fixing unit 60 passes through the sheet discharge roller pair 61, and is then discharged toward a stack portion provided outside the casing of the printer.

The transfer unit 20 includes the mark detection sensor 33 inside the loop of the sheet feeding belt 21. The mark detection sensor 33 detects speed detection marks (not shown) put at predetermined pitches over the perimeter at the back side of the sheet feeding belt 21. Every time the mark detection sensor 33 detects each speed detection mark, the sensor 33 sends a detection signal to the controller (not shown). The controller detects a change in the speed of the sheet feeding belt 21 based on a change in the time interval of the detection signal sent from the mark detection sensor 33. When detecting a change in speed, the controller sets the speed of the sheet feeding belt 21 close to the target speed by changing the rotational speed of the drive motor that is the drive source for the drive roller 32. Such control can suppress a change in the speed of the sheet feeding belt 21, thus restraining shifting and friction of the transfer position of each color toner image originated from the change in the speed of the sheet feeding belt.

Figure 3:
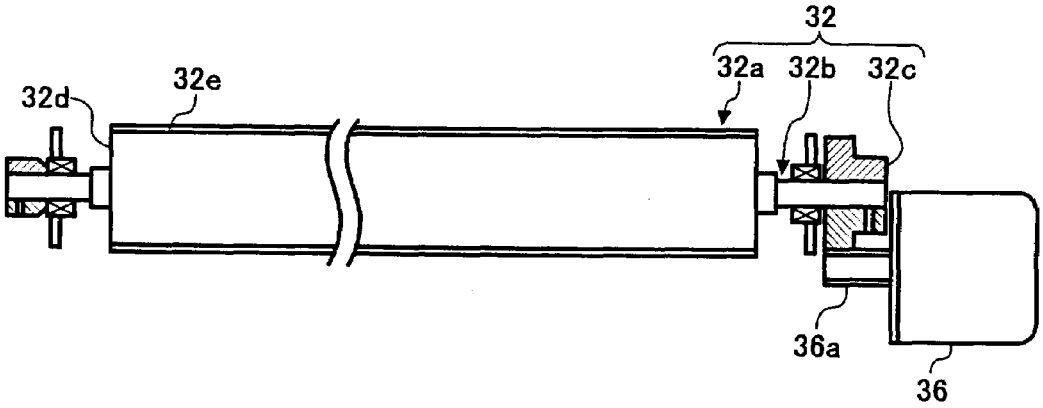
FIG. 3 is an enlarged view of a drive roller of the transfer unit.

FIG. 3 is an enlarged view of the drive roller 32 of the transfer unit 20. The drive roller 32 includes a roller portion 32*a*, shaft portions 32*b* protruding from both end faces in the axial direction of the roller portion 32*a*, and a gear 32*c* fixed to one of the shaft portions 32*b*. The roller portion 32*a* has a metal cored bar 32*d*, and a resilient layer 32*e* of a resilient material, such as rubber, coated on the front side of the cored bar 32*d*. The provision of the resilient layer 32*e* at the roller portion 32*a* makes the friction resistance between the drive roller 32 and the sheet feeding belt 21 greater, so that the sheet feeding belt 21 can be surely moved in an endless-belt manner. A drive motor 36 or a drive source for rotating the drive roller 32 is laid out near the drive roller 32. A gear portion provided at a rotation drive shaft 36*a* of the drive motor 36 engages with the gear 32*c* fixed to the shaft portion 32*b* of the drive roller 32. The gear engagement allows the rotary drive force of the drive motor 36 to be transferred to the drive roller 32 via the gear portion of the rotation drive shaft 36*a* and the gear 32*c*.

The primary cause for a change in the speed of the sheet feeding belt 21 shown in FIG. 1 is an error in the circumferential thickness of the sheet feeding belt 21.

Figure 4:
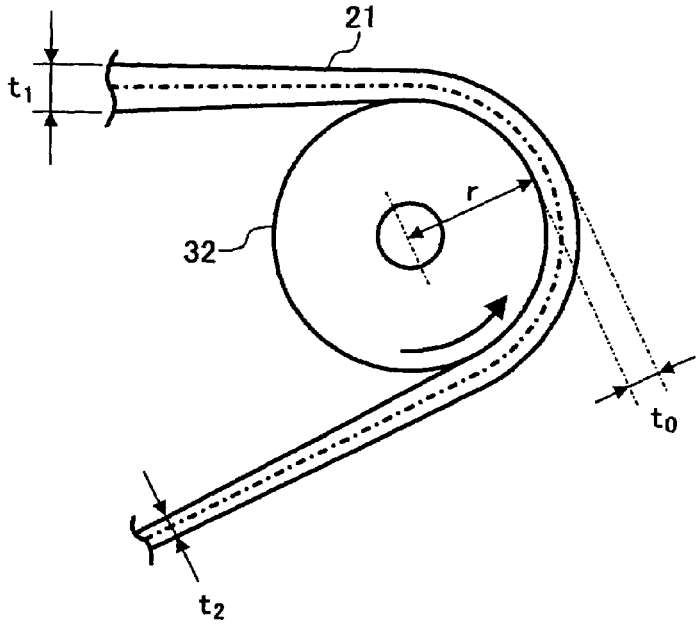
FIG. 4 is an enlarged view of the drive roller and a sheet feeding belt.

FIG. 4 is an enlarged view of the drive roller 32 and the sheet feeding belt 21. The sheet feeding belt 21 is given the counterclockwise moving force in FIG. 4 at the roll-on-belt position of the drive roller 32. The speed V of the moving force depends on the rotational speed N revolution per minute (rpm) of the drive roller 32, the radius r of the drive roller 32, and the thickness of the sheet feeding belt 21 at the roll-on-belt position of the drive roller 32. Specifically, in this example, the thickness of the sheet feeding belt 21 at the roll-on-belt position of the drive roller 32 is t0. In this case, the speed V given to the sheet feeding belt 21 becomes "$2\pi\times N(r+\frac{1}{2}\times t0)$", where $\pi$ is the circular constant. At a timing a little earlier than the shown timing, however, the thickness of the sheet feeding belt 21 at the roll-on-belt position of the drive roller 32 becomes t1 greater than t0. In the case, the speed V given to the sheet feeding belt 21 becomes "$2\pi\times N(r+\frac{1}{2}\times t1)$", so that the speed of the sheet feeding belt 21 becomes faster than the one at the shown timing. At a timing slightly later than the shown timing, the thickness of the sheet feeding belt 21 at the roll-on-belt position of the drive roller 32 becomes t2 smaller than t0. In this case, the speed V given to the sheet feeding belt 21 becomes "$2\pi\times N(r+\frac{1}{2}\times t2)$", so that the speed of the sheet feeding belt 21 becomes slower than the one at the shown timing. Apparently, the speed V of the sheet feeding belt 21 changes due to the thickness error in a direction of circumference.

Figure 5:
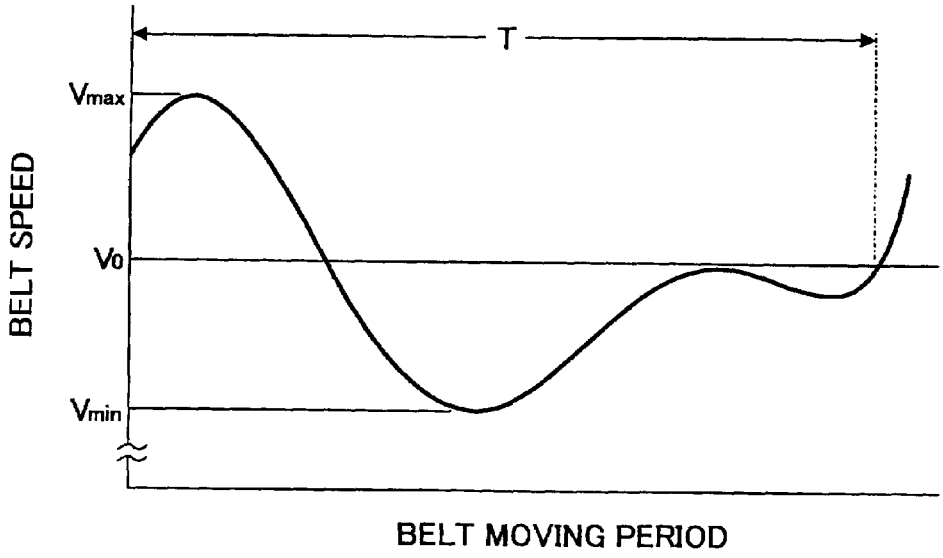
FIG. 5 is a graph of speed variations of a sheet feeding belt per turn.

FIG. 5 is a graph of speed variations of the sheet feeding belt 21 per turn. The graph depicts an example where a sinusoidal speed change for one period while the sheet feeding belt 21 makes one endless-belt movement (one period T). $V_0$, $V_{max}$, and $V_{min}$ shown in FIG. 5 respectively indicate the average speed, the maximum speed, and the minimum speed of the sheet feeding belt 21 per turn.

When the belt base of the sheet feeding belt 21 is manufactured by injection molding, the sheet feeding belt 21 is apt to cause such a shown speed change. Specifically, in injection molding, first, a belt material is supplied between a cylindrical outer mold and a drum-like inner mold fixed inside the outer mold, and is then hardened. The hardened annular molded product is separated from the outer mold and the inner mold, yielding a belt base. When the belt base is molded this way, a slight center misalignment of the cylindrical outer mold and the drum-like inner mold is unavoidable, thus causing decentering between the molds. The decentering produces a portion at which the gap between both molds is maximum and a portion in which the gap between both molds is minimum. This produces a thickness error in the direction of circumference. The portion that is shifted by a phase of 180 degrees from the portion in which the mold gap is maximum is the portion where the mold gap is minimum. In other words, that portion of the belt base manufactured by injection molding that is shifted by a phase of 180 degrees from the portion that has the maximum thickness has the minimum mold gap.

To suppress a change in the speed of the sheet feeding belt 21 originated from the thickness error in the direction of circumference, the printer has the mark detection sensor 33 provided inside the loop of the sheet feeding belt 21 as shown in FIG. 1.

In the structure, a visible image forming unit that forms a toner image or a visible image on a transfer sheet as a sheet-like recording medium is constituted by the combination of the process units 1Y, 1M, 1C, and 1K, the transfer unit 20. The transfer unit 20 serves as a belt driving unit that moves the sheet feeding belt 21 or an annular belt member in an endless-belt manner so that the sheet feeding belt 21 passes positions facing the photosensitive elements 2Y, 2M, 2C, and 2K as latent image carriers. The transfer unit 20 also serves as the transfer unit that transfers a toner image, developed by the belt driving unit or the developing unit, from the front side of each photosensitive element to the sheet feeding belt.

Figure 6:
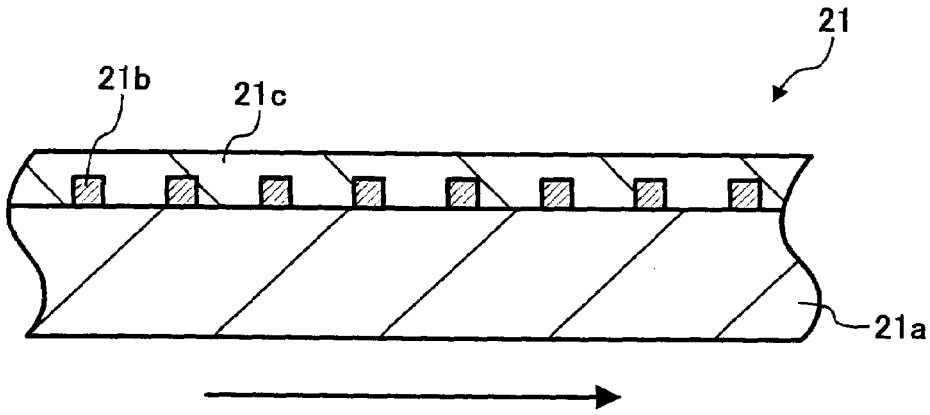
FIG. 6 is an enlarged cross-section of the sheet feeding belt.

FIG. 6 is enlarged cross-section of the sheet feeding belt 21. The cross-section illustrates the sheet feeding belt 21 cut along the direction of circumference. In FIG. 6, the upper belt surface is the back side, and the lower belt side is the front side. Marks 21*b* formed of a light reflection material are provided at the back side of a belt base 21*a* of the sheet feeding belt 21, which is moved in an endless-belt manner in the arrow direction in FIG. 6, in such a manner that the marks 21*b* are aligned at predetermined pitches in the direction of circumference of the sheet feeding belt 21. A protection layer 21*c* of an optically transparent material with an excellent light transparency selected from light transmitting materials is coated on the marks 21*b* over the entire belt surface.

Figure 7:
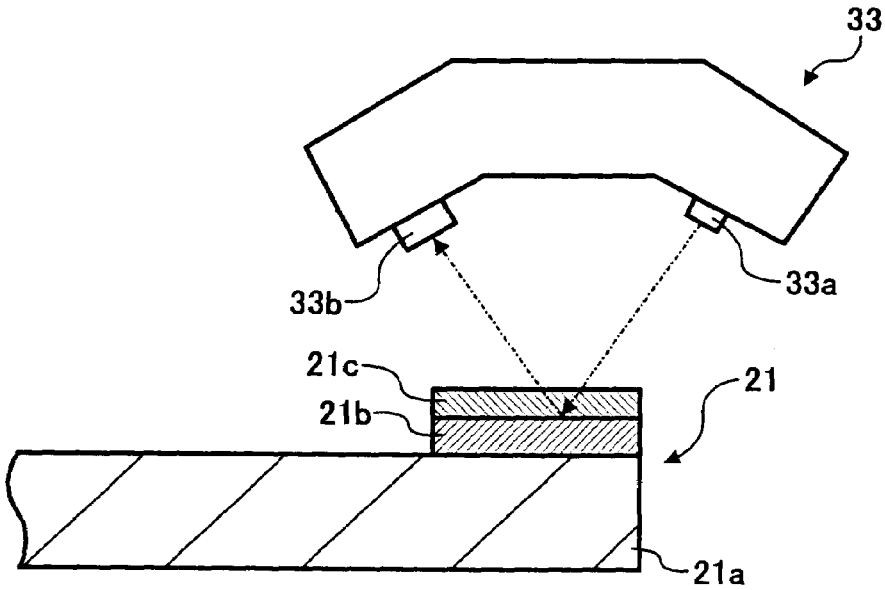
FIG. 7 is an enlarged cross-section of the sheet feeding belt and a mark detection sensor.

FIG. 7 is an enlarged cross-section of the lateral cross-section of the sheet feeding belt 21 and the mark detection sensor 33. The sheet feeding belt 21 is moved in an endless-belt manner in the depth direction in FIG. 7. The marks 21*b* and the protection layer 21*c* coated on the marks are provided at one end portion of the belt base 21*a* in a direction of width. The mark detection sensor 33 constituted by a reflective photosensor is provided above that one end portion of the belt base 21*a* in FIG. 7. The mark detection sensor 33 includes a light emitting element 33*a* as a light emitting unit to emit light, and a light receiving element 33*b* as a light receiving unit that outputs a voltage according to the amount of light received. The light emitted from the light emitting element 33*a* is irradiated toward the protection layer 21*c* of the sheet feeding belt 21. The light passes through the transparent protection layer 21*c*, and is then reflected at the front side of the mark 21*b* by a predetermined reflection angle to become reflected light. After passing the protection layer 21*c* in the opposite direction, the reflected light is received by the light receiving element 33*b* of the mark detection sensor 33. The mark detection sensor 33 detects the mark 21*b* based on a rapid increase in the amount of light received. The mark detection sensor 33 sends a mark detection signal according to the amount of light received to the controller (not shown). The controller detects a change in the speed of the sheet feeding belt 21 based on a change in the detection interval of the mark detection signal.

The cleaning blade (35*a* in FIG. 1) of a belt cleaning unit (not shown) abuts on the front side of the sheet feeding belt 21 (the side facing downward in FIG. 7) where the marks 21*b* and the protection layer 21 are not provided. Therefore, damaging of the protection layer 21*c* by friction with the cleaning blade can be avoided.

As the protection layer 21*c* having a light transparency and requiring no surface processing with chemicals or polishing protects the marks 21*b* in the structure, adhesion of stain on the marks 21*b* is suppressed better as compared with a case that the marks 21*b* are exposed. This structure can suppress degrading of mark detection precision that is otherwise originated from adhesion of stain on the marks 21*b*. As damaging of the protection layer 21*c* from the friction with the cleaning blade is avoided, degrading of mark detection precision that is otherwise originated from damages on the protection layer 21*c* can also be suppressed.

While the foregoing description has been given of an example where the belt base 21*a* is a single layer, the belt base can also take a multi-layer structure. In addition, belt bases manufactured by centrifugal molding, extruding (injection molding), dipping, coating, and the like can be used as the belt base 21*a*.

Examples of the materials for the belt base 21*a* are polyimide, polyether sulfone, polycarbonate, polyester, polyallylate, polyphenylene sulfide, polyamide, polysulfone, and polyprabanic acid. Fluororesin, polyamide-imide, polyether imide, thermoset unsaturated polyester, thermoset epoxy resin, and the like can be also used.

Examples of the materials for the mark 21*b* are metallic materials with a high light reflectance, such as aluminum and copper. An example of the method of providing the plural marks 21*b* at the back side of the belt base 21*a* is to coat a metallic material on the back side by vapor deposition and then remove unnecessary portions by the photolithography technology. Laser processing can be used as the method of removing unnecessary portions. The metallic material cannot be vapor-deposited, but instead, a metallic glazing tape with a high light reflectance, such as vapor-deposited polyester or Rapi tape (product name, produced by Cemedine) can be adhered. A tape member with the marks 21*b* formed at predetermined pitches beforehand can be adhered to the back side of the belt base 21*a*.

Possible examples of the materials for the protection layer 21*c* are a transparent resin, such as polyethylene terephthalate (PET) or acrylic, and transparent ceramics. Spray coating, print, coating, and adhesion of a tape-like protection layer 21*c* can be used as the method of coating the protection layer 21*c* on the marks 21*b*.

In the printer, the mark detection sensor 33 detects marks on the sheet feeding belt 21 located under the sensor 33 in a vertical direction as shown in FIG. 1. As shown in FIG. 7, the structure sets the light emitting element 33*a* as the light emitting unit and the light receiving element 33*b* as the light receiving unit to face downward in the vertical direction. This suppresses stain on the light emitting element 33*a* and the light receiving element 33*b* originated from deposition of dust or the like more than the case that both elements take positions facing upward in the vertical direction. This can suppress degrading of mark detection precision originated from stain on the light emitting element 33*a* and the light receiving element 33*b*.

Figure 8:
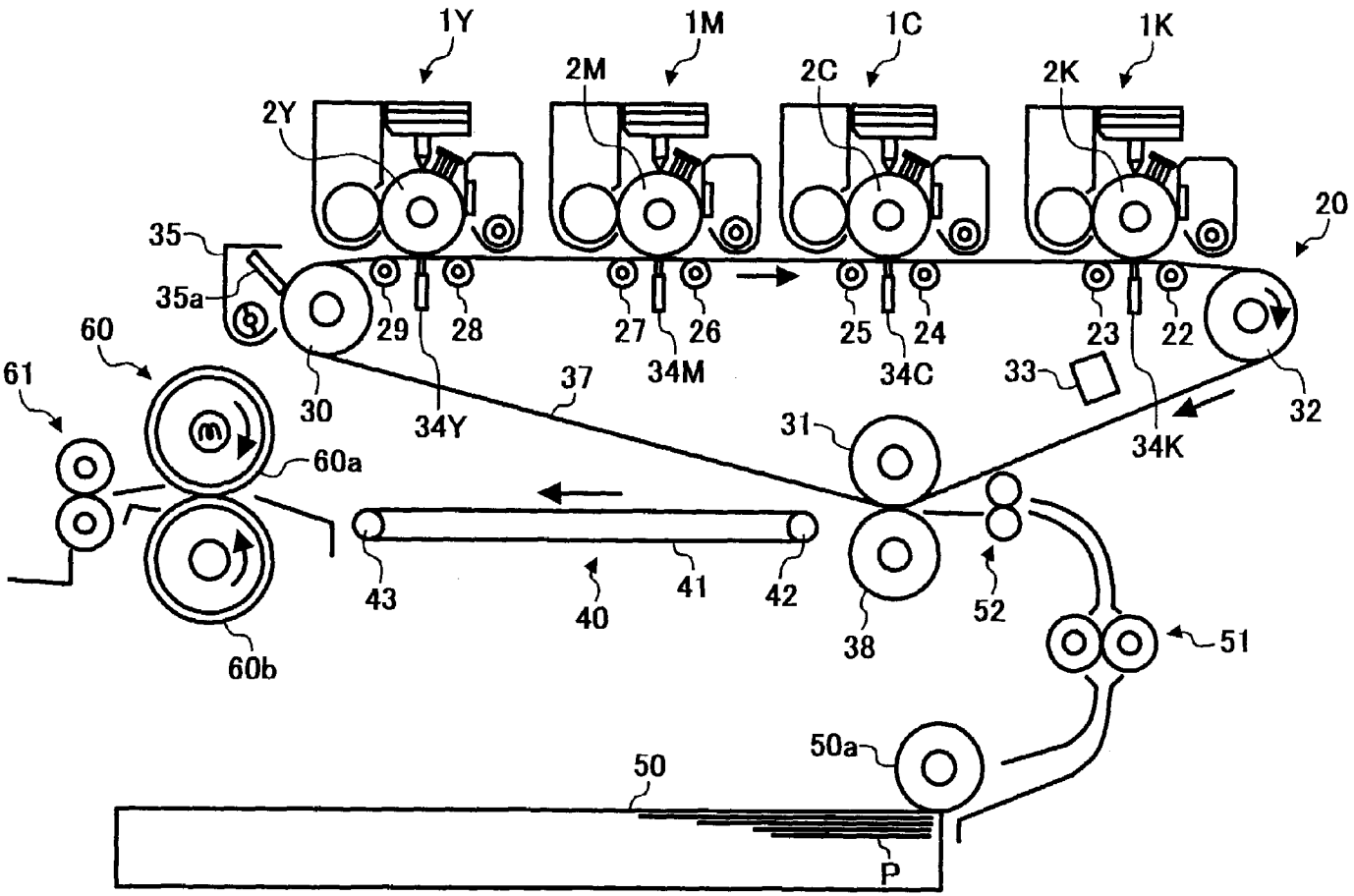
FIG. 8 is a schematic of a first modification of the printer.

FIG. 8 is schematic of a first modification of the printer. A printer in the first modification essentially differs from the printer as shown in FIG. 1 in that an intermediate transfer belt 37, not a sheet feeding belt, is used as the belt member of the transfer unit 20. The layout order of the process units 1Y, 1M, 1C, and 1K is opposite to the one shown in FIG. 1. The direction of the endless-belt movement of the intermediate transfer belt 37 is also opposite to the one shown in FIG. 1.

The intermediate transfer belt 37 is moved clockwise in FIG. 8 in an endless-belt manner by the drive roller 32 while being stretched by the stretch rollers 22 to 32. The top stretch side of the intermediate transfer belt 37 abuts on the photosensitive elements 2Y, 2M, 2C, and 2K of the process units, thereby forming primary transfer nips. When the intermediate transfer belt 37 passes the primary transfer nips, Y, M, C, and K toner images on the photosensitive elements 2Y, 2M, 2C, and 2K are sequentially transferred, one on another, on the front side (primary transfer). As a result, a toner image with four colors overlapping one another (hereinafter, "four-color toner image") is formed on the front side of the intermediate transfer belt 37.

Among the stretch rollers that stretch the intermediate transfer belt 37, the stretch roller 31 laid at the lowest location in the vertical direction is grounded. A secondary transfer roller 38 abuts on the stretch roller 31 via the intermediate transfer belt 37. This forms a secondary transfer nip at which the front side of the intermediate transfer belt 37 abuts on the secondary transfer roller 38. At and around the secondary transfer nip, a secondary transfer electric field is formed between the grounded stretch roller 31 and the secondary transfer roller 38 to which a secondary transfer bias of the opposite polarity to that of the toner is applied by a secondary transfer bias power source (not shown).

The pair of resisting rollers 52 feed a transfer sheet P tucked between the rollers toward the secondary transfer nip at such timing as to permit the transfer sheet P to overlie the four-color toner image on the intermediate transfer belt 37. The four-color toner image on the intermediate transfer belt 37 is transferred on the transfer sheet P at a time by the actions of the transfer sheet P, which has entered the secondary transfer nip, and the secondary transfer electric field (secondary transfer). The four-color toner image, together with the white background color of the transfer sheet P, becomes a full color image.

The transfer sheet P on which the full color image has been formed at the secondary transfer nip is supplied to a conveyance unit 40 that moves a post-transfer feeding belt 41 counterclockwise in FIG. 8 in an endless-belt manner while being stretched by stretch rollers 41 and 42. The transfer sheet P is conveyed held on the top stretch side of the post-transfer feeding belt 41, and is given to the fixing unit 60.

The mark detection sensor 33 located inside the intermediate transfer belt 37 detects marks (not shown) put on the back side of the intermediate transfer belt 37. Marks are formed at given pitches on the back side of the intermediate transfer belt 37 in the direction of circumference as on the sheet feeding belt of the printer according to the embodiment, and a protection layer of a transparent material is coated on the marks. In other words, the printer in the first modification detects a change in the speed of the intermediate transfer belt 37 as the belt member based on the detection intervals of the marks, and suppresses the change in speed.

According to the printer in the first modification, the mark detection sensor 33 is also caused to detect the marks on the sheet feeding belt 21 located under the mark detection sensor 33 in the vertical direction. The light emitting element 33*a* and the light receiving element 33*b* are set facing downward in the vertical direction, thereby suppressing stain on the light emitting element 33*a* and the light receiving element 33*b* originated from deposition of dust or the like.

Figure 9:
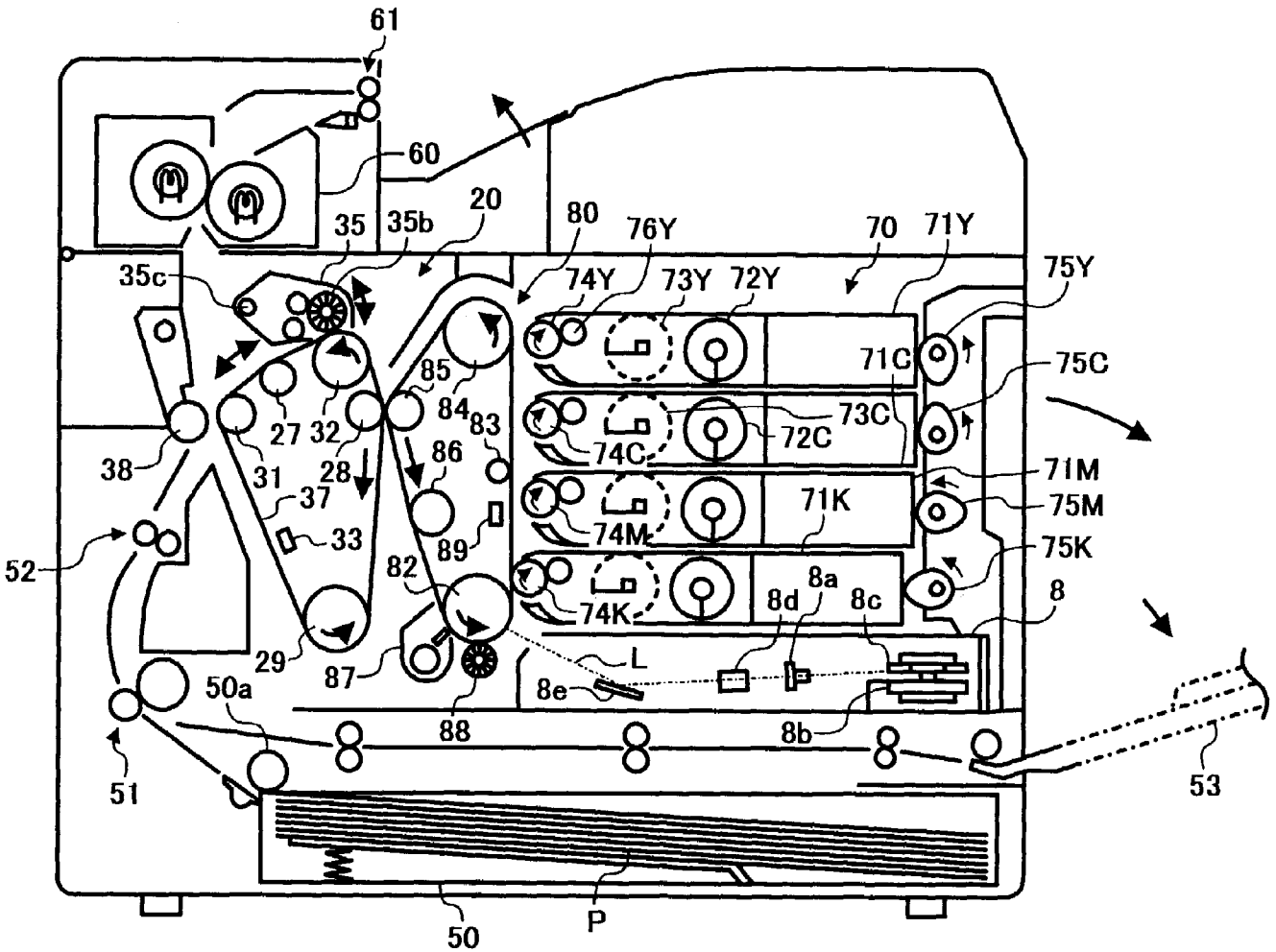
FIG. 9 is a schematic of a second modification of the printer.

FIG. 9 is a schematic of a second modification of the printer. The printer in the second modification has a developing unit 70, a photosensitive element unit 80 and an optical writing unit 8 instead of the process units (1Y, 1M, 1C, and 1K) shown in FIG. 1.

The photosensitive element unit 80 as a belt driving unit stretches a photoconductive belt 81 as an annular belt member with a plurality of stretch rollers 82 to 86. As the drive roller 82, one of the stretch rollers, is rotated counterclockwise in FIG. 9 by a driving unit (not shown), the photoconductive belt 81 is moved counterclockwise in FIG. 9, in an endless-belt manner. The photosensitive element unit 80 includes a belt cleaning unit 87, a uniform charger 88, and a deelectrifying unit (not shown) in addition to the photoconductive belt 81 and the stretch rollers.

The developing unit 70 having four developing devices 71Y, 71M, 71C, and 71K is laid out on the right side to the photosensitive element unit 80 in FIG. 9. Each of the four developing devices 71Y, 71M, 71C, and 71K is so constructed as to be slidable rightward and leftward in FIG. 9 and is urged rightward from the left side in FIG. 9 by a urging unit (not shown), such as a spring. The developing devices. 71Y, 71M, 71C, and 71K have nearly the same structures, except that the toners in use have different colors. The developing device 71Y, for example, includes a supply screw 72Y, an agitator 73Y, a developing roller 74Y, an eccentric cam 75Y, and a toner supply roller 76Y. A toner containing unit (not shown) for containing the Y toner is formed in the casing of the developing device 71Y at an area on the right-hand side in FIG. 9. The Y toner in the toner containing unit is supplied to the developing unit located on the left to the toner containing unit by the supply screw 72Y. The Y toner is supplied toward the toner supply roller 76Y in the developing unit by the agitator 73Y, which rotates counterclockwise in FIG. 9. The toner supply roller 76Y of which a surface is made of a porous material, such as sponge or urethane foam, to easily hold the toner takes the Y toner, fed from the agitator 73Y, into the surface. While abutting on the developing roller 74Y that is rotated clockwise in FIG. 9, the toner supply roller 76Y is rotated counterclockwise in FIG. 9, so that the front side is moved at the abutting portion in the same direction as the moving direction of the developing roller 74Y. The toner supply roller 76Y supplies the Y toner, taken inside the surface, to the developing roller 74Y. The developing roller 74Y holds the Y toner supplied from the toner supply roller 76Y on its front side, and feeds the Y toner to the developing area opposite to the photoconductive belt 81 of the photosensitive element unit 80.

Each of the developing devices 71Y, 71M, 71C, and 71K can move the casing, urged rightward from the left side in FIG. 9, as the associated eccentric cam 75Y, 75M, 75C, or 75K laid right to the casing in FIG. 9 is rotated by a predetermined angle. This causes the developing devices 71Y, 71M, 71C, and 71K to move to the positions where their developing rollers 74Y, 74M, 74C, and 74K abut on the photoconductive belt 81. As the eccentric cams 75Y, 75M, 75C, and 75K of the developing devices 71Y, 71M, 71C, and 71K are further rotated by a predetermined angle, the urging force of the eccentric cams 75Y, 75M, 75C, and 75K acting leftward in FIG. 9 can be released to retreat the casing from the developing position. FIG. 9 depicts that the developing device 71K for black is positioned at the developing position, and the other developing devices 71Y, 71M, and 71C are retreated from the developing position.

With the printer body being in a standby state in which it is not doing a print operation, all the developing devices 71Y, 71M, 71C, and 71K are retreated from the developing position. During printing, either all the developing devices 71Y, 71M, 71C, and 71K are retreated from the developing position or one of the developing devices 71Y, 71M, 71C, and 71K alone is at the developing position. To replace the developing device 71Y, 71M, 71C, or 71K or supply the associated toner thereto, the door on the casing located right to the developing unit 70 in FIG. 9 should be opened so that any developing device can be detached or attached through the door.

The photoconductive belt 81 of the photosensitive element unit 80 has a photoconductive layer coated on the front side. The uniform charger 88 abuts on the roll-on-belt portion of the front side of the photoconductive belt 81 that is put around the drive roller 82 is the lowest one of the stretch rollers in the vertical direction. After the front side of the photoconductive belt 81 is uniformly charged by the uniform charger 88, the photoconductive belt 81 goes to the optical writing position along the counterclockwise endless-belt movement in FIG. 9.

The optical writing unit 8 is disposed under the developing unit 70 in FIG. 9. The optical writing unit 8 includes a semiconductor laser beam source 8*a*, a polygon mirror 8*c* that is rotated by a polygon motor 8*b*, an image forming optical system 8*d*, and a reflection mirror 8*e*. Based on one of four pieces of color resolution image information sent from a personal computer or the like (not shown), the semiconductor laser beam source 8*a* is driven. Accordingly, a laser beam L emitted from the semiconductor laser beam source 31 is reflected at the rotating polygon mirror 8*c* of a hexahedron shape, and deflected in the direction of width. The deflected laser beam L sequentially passes the image forming optical system 8*d* and the reflection mirror 8*e*, and reaches the photoconductive belt 81. The laser beam L then optically scans the photoconductive belt 81 to form an electrostatic latent image of one of the colors Y, M, C, and K on the photoconductive belt 81. The latent image formed is developed by the associated one of the developing devices 71Y, 71M, 71C, and 71K that uses the toner of the associated color, yielding a toner image.

The transfer unit 20 that moves the intermediate transfer belt 37 clockwise in FIG. 9 in an endless-belt manner while stretching them with plural stretch rollers 27 to 32 is disposed left to the photosensitive element unit 80 in FIG. 9. The transfer unit 20 can rock the entire unit about the rotational axis of the stretch roller 29 laid lowest in the stretch rollers in the vertical direction. As the whole unit is pulled rightward in FIG. 9, the intermediate transfer belt 37 can abut on the photoconductive belt 81 of the photosensitive element unit 80. This forms the primary transfer nip at which the intermediate transfer belt 37 and the photoconductive belt 81 abut on each other. At and around the primary transfer nip, a primary transfer electric field is formed between the stretch roller 28 and the stretch roller 85 that stretches the photoconductive belt 81 as a primary transfer bias is applied to the stretch roller 28 that stretches the intermediate transfer belt 37.

The transfer unit 20 can cause the belt cleaning unit 35, which cleans the front side of the intermediate transfer belt 37, to contact and move away from the front side of the intermediate transfer belt 37 by rocking the belt cleaning unit 35 about a rocking shaft 35*c*. When the entire transfer unit 20 is pulled rightward in FIG. 9 to form the primary transfer nip, the belt cleaning unit 35 is separated from the intermediate transfer belt 37.

When the entire transfer unit 20 is pulled leftward in FIG. 9 about the rotational axis of the stretch roller 29, the intermediate transfer belt 37 and the photoconductive belt 81, which have been in abutment with each other, are separated from each other. At the same time, the intermediate transfer belt 37 and the secondary transfer roller 38 disposed on the left in FIG. 9, which have been separated from each other, abut on each other, forming the secondary transfer nip.

When the full color print mode to form a full color image is executed, first, the transfer unit 20 is pulled rightward in FIG. 9 about the rotational axis of the stretch roller 29, forming the primary transfer nip at which the intermediate transfer belt 37 and the photoconductive belt 81 abut on each other. The belt cleaning unit 35 is pulled leftward in FIG. 9 about the rocking shaft 35*c*, and is separated from the intermediate transfer belt 37. Those belts are driven and the front side of the photoconductive belt 81 is uniformly charged at the position where the front side contacts the uniform charger 88. The optical writing unit starts optical scanning of the photoconductive belt 81 based on the Y resolution image information to form an electrostatic latent image for Y on the photoconductive belt 81. The initiation timing of the optical scanning is determined based on the detection timing of a reference mark to be described later, which is provided on the intermediate transfer belt 37.

Figure 10:
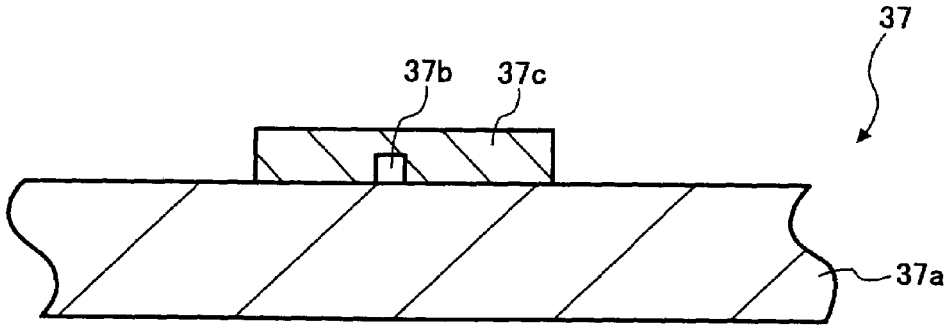
FIG. 10 is an enlarged cross-section of an intermediate transfer belt of the second modification.

FIG. 10 is an enlarged cross-section of a part of the intermediate transfer belt 37. In FIG. 10, the side facing upward and the side facing downward are respectively the back side and the front side of the intermediate transfer belt 37. A reference mark 37*b* of a light reflection material is provided at the back of a belt base 37*a* of the intermediate transfer belt 37. The reference mark 37*b* is provided one at a predetermined position in the direction of circumference of the belt base 37*a*, not plural locations along the direction of circumference. A protection layer 37*c* of a transparent material is coated on the reference mark 37*b*.

With reference to FIG. 9, the mark detection sensor 33 constituted by a reflective photosensor is laid inside the loop of the intermediate transfer belt 37. The mark detection sensor 33 detects the reference mark 37*b*, and sends a detection signal to the controller (not shown). The controller determines optical writing initiation timing for the electrostatic latent image for Y based on the timing at which the mark detection sensor 33 detects the reference mark, i.e., the timing at which the intermediate transfer belt 37 moves the reference mark at the back to the position facing the mark detection sensor 33. As the protection layer of a transparent material is coated on the reference mark, degrading of mark detection precision originated from stain on the reference mark can be suppressed as per the sheet feeding belt of the printer according to the embodiment.

Before the leading portion of the electrostatic latent image for Y formed on the photoconductive belt 81 enters the position facing the developing device 71Y for Y of the developing unit 70, the developing device 71Y moves to the developing position by the rotation of the eccentric cam 75Y. The electrostatic latent image for Y is developed into a Y toner image by the developing roller 74Y that rotates in contact with the photoconductive belt 81.

The Y toner image developed on the photoconductive belt 81 or the latent image carrying belt enters the primary transfer nip with the endless-belt movement of the photoconductive belt 81. The primary transfer of the Y toner image on the intermediate transfer belt 37 is carried out by the actions of the primary transfer electric field and the nip pressure. The transfer residual toners are then cleaned with the belt cleaning unit 87 of the photosensitive element unit 80, and the residual charges are removed by the deelectrifying unit (not shown). The front side of the photoconductive belt 81 is then uniformly charged by the uniform charger 88.

The Y toner image transferred on the intermediate transfer belt 37 in the primary transfer returns to the primary transfer nip with the endless-belt movement of the intermediate transfer belt 37. At the timing where overlapped transfer onto the Y toner image returning to the primary transfer nip, formation of a toner image of the next color, M, starts. To determine the timing, it is necessary to grasp where on the belt moving track the leading portion of the Y toner image on the intermediate transfer belt 37 is positioned, i.e., where on the belt moving track the reference position in the direction of circumference is. In this respect, the printer in the second modification detects the reference mark provided at a predetermined position of the back side of the intermediate transfer belt 37 in the direction of circumference. The optical writing initiation timing for forming an electrostatic latent image for each color is determined based on the detection timing for the reference mark. Accordingly, optical writing of an electrostatic latent image for each color can be started at the timing where each of the M, C, and K toner images on the photoconductive belt 81 is placed over the Y toner image on the intermediate transfer belt 37 at the primary transfer nip.

When the optical writing initiation timing for an electrostatic latent image for M comes, the optical writing unit 8 performs optical scanning on the photoconductive belt 81 based on M resolution image information, thus forming the electrostatic latent image for M. Before the leading portion of the electrostatic latent image for M enters the position facing the developing device 71Y for Y of the developing unit 70, the developing device 71Y retreats from the developing position by the rotation of the eccentric cam 75Y. Before the leading portion of the electrostatic latent image for M enters the position facing the developing device 71M for M of the developing unit 70, the developing device 71M moves to the developing position by the rotation of the eccentric cam 75M. The electrostatic latent image for M is developed into an M toner image by the developing roller 74M that rotates in contact with the photoconductive belt 81. The formation of the M toner image starts at the timing where the M toner image is placed over the Y toner image on the intermediate transfer belt 37 at the primary transfer nip. Accordingly, the M toner image is transferred, as the primary transfer, over the Y toner image on the intermediate transfer belt 37 at the primary transfer nip.

The subsequent C toner image and K toner image are formed in a similar manner and transferred over the intermediate transfer belt 37 at the primary transfer nip. When four-color toner image is formed on the intermediate transfer belt 37 through overlapping of four colors, the entire transfer unit 20 is pulled leftward in FIG. 10, separating the intermediate transfer belt 37 from the photoconductive belt 81 and causing the intermediate transfer belt 37 to abut on the secondary transfer roller 38. In synchronism with the entry of the four-color toner image on the intermediate transfer belt 37 to the secondary transfer nip formed by the abutment, the transfer sheet P is fed toward the secondary transfer nip from a pair of the resisting rollers 52. The four-color toner image on the intermediate transfer belt 37 is then transferred on the transfer sheet P as the secondary-transfer at a time, yielding a full color image.

When the trailing ends of the four-color toner image on the intermediate transfer belt 37 passes the position facing the belt cleaning unit 35 after the entire transfer unit 20 has been pulled leftward in FIG. 10 to form the secondary transfer nip, the transfer unit 20 causes the belt cleaning unit 35 to contact the intermediate transfer belt 37. The transfer residual toners remaining untransferred on the transfer sheet P at the secondary transfer nip are then cleaned off the intermediate transfer belt 37.

The printer in the second modification can permit sheet feeding from a manual tray 53 instead of sheet feeding from the sheet feeding cassette 50.

The photoconductive belt 81 of the photosensitive element unit 80 as the belt driving unit, like the sheet feeding belt of the printer according to the embodiment, has a plurality of marks laid at predetermined pitches in the direction of circumference. A protection layer of a transparent material is coated on the marks. A mark detection sensor 89 constituted by a reflective photosensor is laid inside the loop of the photoconductiove belt 81. The mark detection sensor 89 detects the marks provided at the back of the photoconductive belt 81, and sends their detection signals to the controller (not shown). The controller detects a change in the speed of the photoconductive belt 81 based on the intervals of the detection signals sent from the mark detection sensor 89 of the photosensitive element unit 80. When a change in speed is detected, the controller changes the drive speed of the photoconductive belt 81, so that the speed approaches the target value. This stabilizes the running speed of the photoconductive belt 81.

Figure 11:
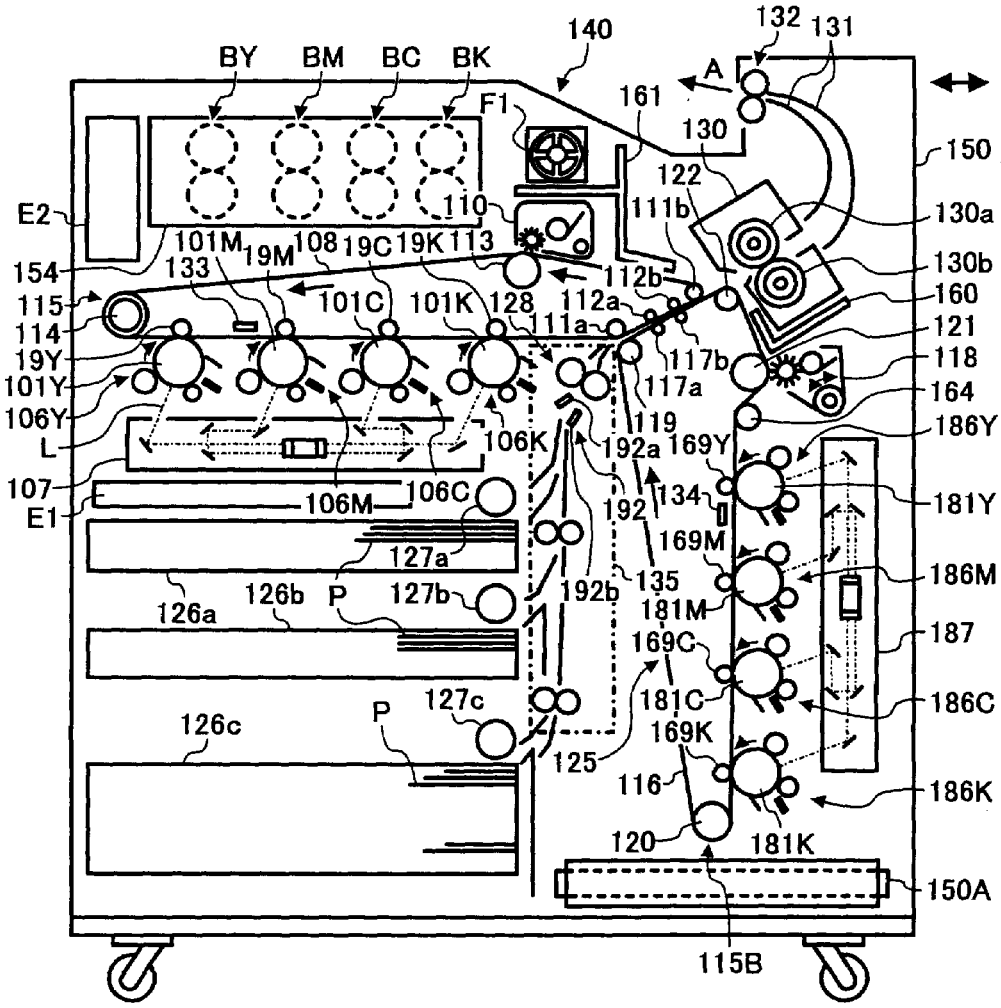
FIG. 11 is a schematic of a third modification of the printer.
Figure 12:
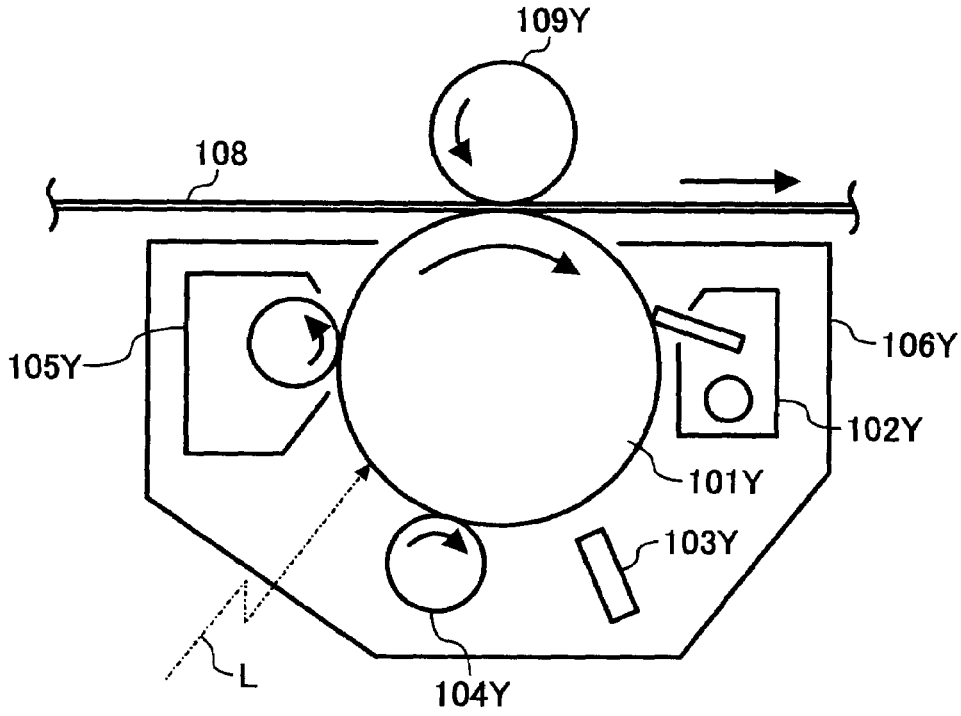
FIG. 12 is an enlarged view of a first process unit for Y in the third modification.

FIG. 11 is a schematic of a third modification of the printer. FIG. 12 is an enlarged view of the first process unit for Y in the third modification. As shown in FIG. 11, the printer in the third modification includes four first process units 106Y, 106M, 106C, and 106K, which have the same structure except for the color of toners to be used. The first process units 106Y, 106M, 106C, and 106K are replaced when their service lives are reached. The first process unit 106Y, taken as an example, includes a drum-like photosensitive element 101Y, a drum cleaning unit 102Y, a deelectrifying unit 103Y, a uniform charger 104Y, and a developing device 105Y. The uniform charger 104Y uniformly charges the front side of the photosensitive element 101Y, which is rotated clockwise in FIG. 11 by a driving unit (not shown). The front side of the photosensitive element 101Y is exposed and scanned with a laser beam L and holds an electrostatic latent image for Y. The electrostatic latent image for Y is developed into a Y toner image by the developing device 105Y using a Y developer. The developed Y toner image is then transferred, as the primary transfer, onto a first intermediate transfer belt 108 to be described later. The drum cleaning unit 102Y removes toners remaining on the front side of the photosensitive element 101Y after the primary transfer step. The deelectrifying unit 103Y deelectrifies residual charges on the photosensitive element 101Y after cleaning. The delectrification initializes the front side of the photosensitive element 101Y to be ready for next image formation. In the other first process units 106M, 106C, and 106K, likewise, M, C, and K toner images are formed on the respective photosensitive elements 101M, 101C, and 101K, and are transferred as the primary transfer onto first intermediate transfer belt 108.

As shown in FIG. 11, a first optical writing unit 107 is placed below the first process units 106Y, 106M, 106C, and 106K in FIG. 11, and an image data processing apparatus E1 is located below the first optical writing unit 107. The image data processing apparatus E1 generates an exposure scanning control signal based on an image information signal sent from a personal computer or the like, and sends the exposure scanning control signal to the first optical writing unit 107. The first optical writing unit 107 generates the laser beam L based on the exposure scanning control signal and irradiates the laser beam L onto the photosensitive elements of the first process units 106Y, 106M, 106C, and 106K. Electrostatic latent images for Y, M, C, and K are formed on the photosensitive elements 101Y, 101M, 101C, and 101K that have been exposed with the irradiation.

Disposed under the image data processing apparatus E1 in FIG. 11 is a sheet feeding unit that includes a first sheet feeding cassette 126*a*, a second sheet feeding cassette 126*b*, a third sheet feeding cassette 126*c*, sheet feeding rollers 127*a*, 127*b*, and 127*c* respectively mounted inn the cassettes, and a pair of resist rollers 128. Each of the three sheet feeding cassettes (126*a*, 126*b*, and 126*c*) contains a pile of plural transfer sheets P. The sheet feeding roller 127*a*, 127*b*, and 127*c* abuts on a transfer sheet P on top of the pile. As each of the sheet feeding rollers 127*a*, 127*b*, and 127*c* is rotated counterclockwise in FIG. 11 by the driving unit (not shown), the transfer sheet P on top is fed toward a sheet feeding path 135. The transfer sheet P enters between the rollers of the resist roller pair 128 located at the lowest downstream side of the sheet feeding path 135. The resist roller pair 128, which rotates both rollers to tuck the transfer sheet P, stops rotating the rollers temporarily when the sheet is tucked. The resist roller pair 128 then sends the transfer sheet P toward the secondary transfer nip to be described later at the adequate timing.

Disposed above the first process units 106Y, 106M, 106C, and 106K is a first transfer unit 115 that moves the first intermediate transfer belt 108 as a belt member in an endless-belt manner while stretching the belt 108. The first transfer unit 115 as the belt driving unit includes four primary transfer rollers 109Y, 109M, 109C, and 109K, and a first belt cleaning unit 110 in addition to the first intermediate transfer belt 108. The first transfer unit 115 also has stretch rollers 111*a*, 111*b*, 112*a*, 112*b*, 113, and 114 that stretch the first intermediate transfer belt 108. The first intermediate transfer belt 108 is moved counterclockwise in FIG. 11 in an endless-belt manner by the rotation of the drive roller 114, one of the stretch rollers, while being stretched by the stretch rollers. The primary transfer rollers 109Y, 109M, 109C, and 109K and the photosensitive elements 101Y, 101M, 101C, and 101K hold the first intermediate transfer belt 108, moved in an endless-belt manner, therebetween, thereby forming primary transfer nips, respectively. While the primary transfer rollers 109Y, 109M, 109C, and 109K are of the type that applies the primary transfer bias of the opposite polarity (for example, positive) to the polarity of the toners to the back side of the first intermediate transfer belt 108 (the inner surface of the loop), the charge type that causes discharging from the electrodes can be used instead.

The first intermediate transfer belt 108 is set to the electric resistance condition suitable for realizing electrostatic transfer with the primary transfer bias. Specifically, the first intermediate transfer belt 108 has a surface layer of a low-surface energy material coated on the belt base of polyimide, polyamide, rubber or the like and 50 micrometers (μm) to 500 μm in thickness, so that the overall volume resistivity is $10^6$ Ωcm to $10^{14}$ Ωcm. The surface resistivity respectively is controlled within a range of $10^5$ Ω/□ to $10^{15}$ Ω/□. Moving in an endless-belt manner, the first intermediate transfer belt 108 sequentially passes the primary transfer nips for Y, M, C, and K. At the individual primary transfer nips, Y, M, C, and K toner images on the photosensitive elements 101Y, 101M, 101C, and 101K are placed one on another to achieve the primary transfer by the actions of the nip pressure and the primary transfer bias. As a result, toner images with four colors overlapping one another (hereinafter, "first four-color toner image") are formed on the front side of the intermediate transfer belt 108.

A second transfer unit 125 is provided lower right of the first transfer unit 115, which is stretching the first intermediate transfer belt 108 in the horizontal direction, in FIG. 11. The second transfer unit 125 stretches a second intermediate transfer belt 116 in the horizontal direction by using a plurality of stretch rollers 117*a*, 117*b*, 119, 120, 121, and 122. The second intermediate transfer belt 116 is moved clockwise in FIG. 11 in an endless-belt manner by the rotation of the drive roller 122 that is one of the stretch rollers. The second transfer unit 125 includes a second belt cleaning unit 118, a press roller 164, and four primary transfer rollers 169Y, 169M, 169C, and 169K in addition to the stretch rollers and the second intermediate transfer belt 116. The primary transfer rollers 169Y, 169M, 169C, and 169K, and the four photosensitive elements of the second process units to be described later hold second intermediate transfer belt 116 therebetween, thereby forming primary transfer nips for primary transfer rollers 169Y, 169M, 169C, and 169K, respectively.

The second intermediate transfer belt 116 has a surface layer of a low-surface energy material, such as fluorine, coated on the belt base of polyimide, polyamide, or the like and 50 μm to 500 μm in thickness, so that the overall volume resistivity is $10^6$ Ωcm to $10^{14}$ Ωcm. The surface resistivity respectively is controlled within a range of $10^5$ Ω/□ to $10^{15}$ Ω/□.

Provided right to the second transfer unit 125 in FIG. 11 are four units of second process units 186Y, 186M, 186C, and 186K aligned at predetermined pitches along the rightward stretch surface of the second intermediate transfer belt 116 in FIG. 11 in the up and down directions. The second process units 186Y, 186M, 186C, and 186K, like the first process units, form Y, M, C, and K toner images on photosensitive elements 181Y, 181M, 181C, and 181K, respectively. Those toner images are placed one on another on the second intermediate transfer belt 116 in the primary transfer to be a second four-color toner image.

An extending portion of the first intermediate transfer belt 108 between the stretch rollers 111*a* and 111*b* abuts on an extending portion of the second intermediate transfer belt 116 between the stretch rollers 119 and 112. This forms a secondary-transfer-belt abutment portion where the first intermediate transfer belt 108 and the second intermediate transfer belt 116 abut on each other long in the surface moving direction.

A bottle container 154 is disposed above the first transfer unit 115 in FIG. 11. Two sets of toner bottles BY, BM, BC, and BK containing toners to be supplied to the developing devices of each first process unit (106Y, 106M, 106C, 106K) and each second process unit (186Y, 186M, 186C, 186K) are contained in the bottle container 154.

A cooling fan F1 that discharges air in the printer body outside is located upper right to the first transfer unit 115 in FIG. 11 to prevent the temperature inside the printer body from rising excessively.

The resist roller pair 128 feeds the transfer sheet P, tucked between the rollers, toward the secondary-transfer-belt abutment portion at the timing at which the transfer sheet P can be set in close contact with the first four-color toner image on the first intermediate transfer belt 108 or the second four-color toner image on the second intermediate transfer belt 116.

At the secondary-transfer-belt abutment portion, the first intermediate transfer belt 108 and the second intermediate transfer belt 116 are held between the upstream stretch roller 112*a* of the first transfer unit 115 and the upstream stretch roller 117*a* of the second transfer unit 125. The region where both belts are held is a first secondary transfer portion.

At the secondary-transfer-belt abutment portion, the first intermediate transfer belt 108 and the second intermediate transfer belt 116 are held between the downstream stretch roller 112*b* of the first transfer unit 115 and the downstream stretch roller 117*b* of the second transfer unit 125. The region where both belts are held is a second secondary transfer portion.

The transfer sheet P fed to the secondary-transfer-belt abutment portion by the resist roller pair 128 sequentially passes the first secondary transfer portion and the second secondary transfer portion.

Figure 13:
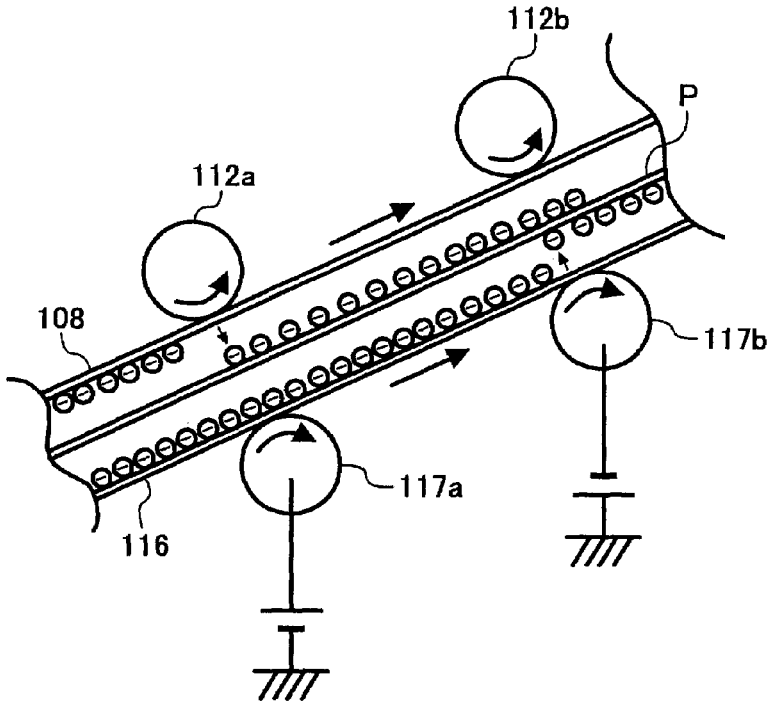
FIG. 13 is a schematic for explaining a first example of an abutment portion of a secondary-transfer-belt in the third modification.

FIG. 13 is a schematic for explaining a first example of an abutment portion of the secondary-transfer-belt in the printer in the third modification. While the secondary-transfer-belt abutment portion is formed by abutment of the first intermediate transfer belt 108 on the second intermediate transfer belt 116, both belts are shown separated from each other in FIG. 13 for the sake of convenience. In the first example, the upstream stretch roller 117*a* in abutment against the back side of the second intermediate transfer belt 116 at the first secondary transfer portion serves as a transfer bias roller to which the transfer bias is applied. The downstream stretch roller 117*b* in abutment against the back side of the second intermediate transfer belt 116 at the second secondary transfer portion also serves as a transfer bias roller to which the transfer bias is applied.

At the first secondary transfer portion, the transfer bias to be applied to the upstream stretch roller 117*a* in abutment against the second intermediate transfer belt 116 has a positive polarity opposite to the charge polarity of the toners. At the second secondary transfer portion, the transfer bias to be applied to the downstream stretch roller 117*b* in abutment against the second intermediate transfer belt 116 has a negative polarity identical to the charge polarity of the toners. The upstream stretch roller 112*a* and the downstream stretch roller 112*b*, which abut on the first intermediate transfer belt, are both grounded.

The transfer sheet P, tucked at the secondary-transfer-belt abutment portion, first enters the first secondary transfer portion. At the first secondary transfer portion, the action of the positive transfer bias whose polarity is opposite to the polarity of the toners forms a transfer electric field as follows. Specifically, the electric field electrostatically attracts the toner image from the upstream stretch roller 112*a* or the transfer-bias-member-facing member toward the upstream stretch roller 117*a* that is the transfer bias member. The electric field causes the first four-color toner image, held on the front side of the first intermediate transfer belt 108, to be electrostatically transferred to the first side of the transfer sheet P from the belt's front side. Electrostatic pull type transfer that electrostatically pulls the toner image toward the transfer bias member is executed at the first secondary transfer portion. At the time of the transfer, the second four-color toner image on the second intermediate transfer belt 116 is pulled toward the second intermediate transfer belt 116 in the opposite direction to the direction toward the second side of the transfer sheet P, so that the second four-color toner image is held on the front side of the second intermediate transfer belt 116.

The transfer sheet P, which has passed the first secondary transfer portion, enters the second secondary transfer portion. At the second secondary transfer portion, the action of the negative transfer bias whose polarity is the same as the polarity of the toners forms a transfer electric field as follows. Specifically, the electric field electrostatically pushes the toner image from the downstream stretch roller 117*b*, which is the transfer bias member, toward the downstream stretch roller 112*b*, which is the transfer-bias-member-facing member. The electric field causes the second four-color toner image, held on the front side of the second intermediate transfer belt 116, to be electrostatically transferred to the second side of the transfer sheet P from the belt's front side. Electrostatic push type transfer that electrostatically pushes the toner image toward the transfer-bias-member-facing member from the transfer bias member is executed at the second secondary transfer portion. At the time of the transfer, the first four-color toner image on the first side of the transfer sheet P is electrostatically pushed toward the first intermediate transfer belt 108 from the first side of the transfer sheet P. However, the experiments conducted by the present inventors did not show that the first four-color toner image, which had undergone the secondary-transfer on the first side at the second secondary transfer portion, was not transferred back to the first intermediate transfer belt 108.

Figure 14:
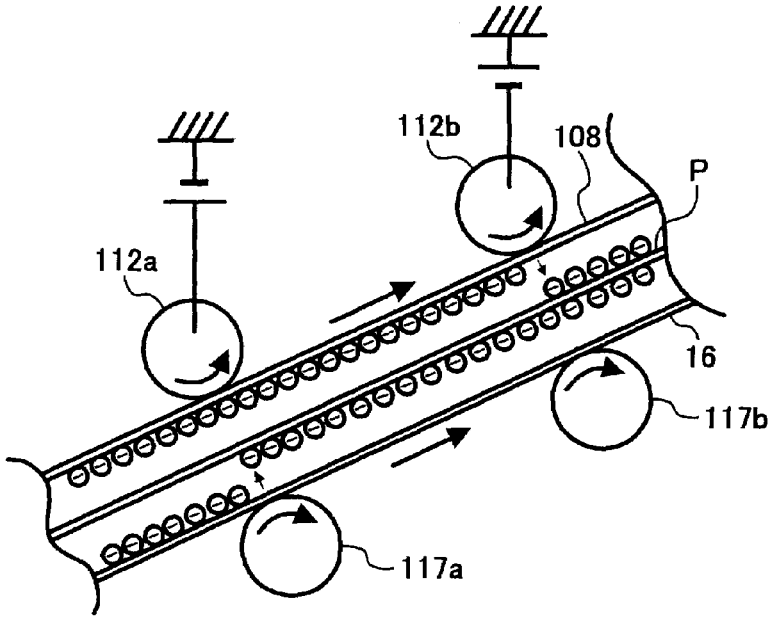
FIG. 14 is a schematic for explaining a second example an abutment portion of a secondary-transfer-belt in the third modification.

The secondary-transfer-belt abutment portion in the printer and the structure around the secondary-transfer-belt abutment portion can take those of the second example as shown in FIG. 14. In the second example, the upstream stretch roller 112*a* abutting on the back side of the first intermediate transfer belt 108 functions as a transfer bias roller to which the transfer bias is applied. The downstream stretch roller 112*b* abutting on the back side of the first intermediate transfer belt 108 also functions as a transfer bias roller to which the transfer bias is applied. At the first secondary transfer portion, the transfer bias to be applied to the upstream stretch roller 112*a*, which is functioning as a transfer bias member, has a positive polarity opposite to the charge polarity of the toners. At the second secondary transfer portion, the transfer bias to be applied to the downstream stretch roller 112*b*, which is functioning as a transfer bias member, has a negative polarity identical to the charge polarity of the toners. The upstream stretch roller 117*a* and the downstream stretch roller 117*b*, which abut on the second intermediate transfer belt 116, are both grounded.

At the first secondary transfer portion, the action of the positive secondary transfer bias whose polarity is opposite to the polarity of the toners forms a transfer electric field as follows. Specifically, the electric field electrostatically attracts the toner image from the upstream stretch roller 117*a* or the transfer-bias-member-facing member toward the upstream stretch roller 112*a* that is the transfer bias member. The electric field causes the second four-color toner image, held on the front side of the second intermediate transfer belt 116, to be electrostatically transferred to the second side of the transfer sheet P from the belt's front side. Electrostatic pull type transfer that electrostatically pulls the toner image toward the transfer bias member is executed at the first secondary transfer portion. At the time of the transfer, the first four-color toner image on the first intermediate transfer belt 108 is pulled toward the first intermediate transfer belt 108 in the opposite direction to the direction toward the first side of the transfer sheet P, so that the first four-color toner image is held on the front side of the first intermediate transfer belt 108.

At the second secondary transfer portion, the action of the negative secondary transfer bias whose polarity is the same as the polarity of the toners forms a transfer electric field as follows. Specifically, the electric field electrostatically pushes the toner image from the downstream stretch roller 112*b*, which is the transfer bias member, toward the downstream stretch roller 117*b*, which is the transfer-bias-member-facing member. The electric field causes the first four-color toner image, held on the front side of the first intermediate transfer belt 108, to be electrostatically transferred to the first side of the transfer sheet P from the belt's front side. Electrostatic push type transfer that electrostatically pushes the toner image toward the transfer-bias-member-facing member from the transfer bias member is executed at the second secondary transfer portion. At the time of the transfer, the second four-color toner image on the second side of the transfer sheet P is electrostatically pushed toward the second intermediate transfer belt 116 from the second side of the transfer sheet P. However, the experiments conducted by the present inventors did not show that the second four-color toner image on the second side was transferred back to the second intermediate transfer belt 116 at the second secondary transfer portion.

Figure 15:
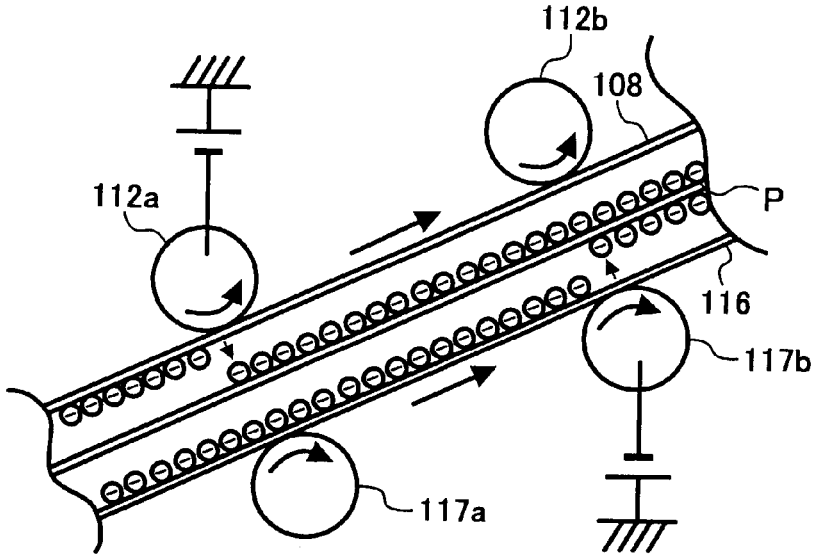
FIG. 15 is a schematic for explaining a third example of an abutment portion of a secondary-transfer-belt in the third modification.

The secondary transfer nip and the structure around that transfer nip can take those of the third example as shown in FIG. 15. In the third example, the upstream stretch roller 112*a* abutting on the back side of the first intermediate transfer belt 108 functions as a transfer bias roller to which the transfer bias is applied. The downstream stretch roller 117*b* abutting on the back side of the second intermediate transfer belt 116 also functions as a transfer bias roller to which the transfer bias is applied. At the first secondary transfer portion, the transfer bias to be applied to the upstream stretch roller 112*a*, which is functioning as a transfer bias member, has a negative polarity that is the same as the charge polarity of the toners. At the second secondary transfer portion, the transfer bias to be applied to the downstream stretch roller 117*b*, which is functioning as a transfer bias member, likewise has a negative polarity identical to the charge polarity of the toners.

At the first secondary transfer portion, electrostatic push type transfer is executed because of the action of the negative secondary transfer bias that has the same polarity as that of the toners. The first four-color toner image on the first intermediate transfer belt 108 is electrostatically pushed toward the upstream stretch roller 117*a* as the transfer-bias-member-facing member from the upstream stretch roller 112*a* as the transfer bias member.

At the second secondary transfer portion, likewise, electrostatic push type transfer is executed because of the action of the negative secondary transfer bias that has the same polarity as that of the toners. The second four-color toner image on the second intermediate transfer belt 116 is electrostatically pushed toward the downstream stretch roller 112*b* as the transfer-bias-member-facing member from the downstream stretch roller 117*b* as the transfer bias member. At the time of the transfer, the first four-color toner image on the first side of the transfer sheet P is electrostatically pushed toward the first intermediate transfer belt 108 from the first side of the transfer sheet P. However, the experiments conducted by the present inventors did not show that the first four-color toner image on the first side at the second secondary transfer portion was transferred back to the first intermediate transfer belt 108. While rollers are used as the transfer bias member and the transfer-bias-member-facing member in the example, non-roller type members can be also used.

Figure 16:
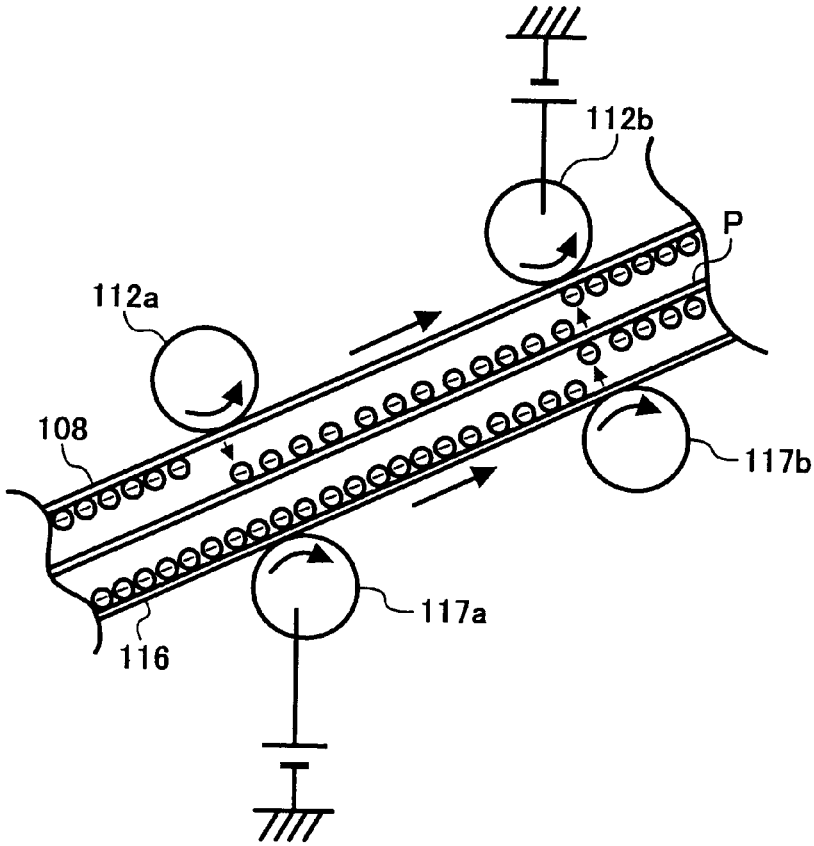
FIG. 16 is a schematic for explaining a comparative example of an abutment portion of a secondary-transfer-belt in the third modification.

Suppose that, as the secondary-transfer-belt abutment portion and the structure around the portion, those of a comparative example shown in FIG. 16 are used. With reference to FIG. 16, electrostatic pull type transfer is performed at both the first secondary transfer portion and the second secondary transfer portion. The present inventors confirmed through experiments that the first four-color toner image on the first side transferred onto the first side of the transfer sheet P at the first secondary transfer portion was transferred back to the first intermediate transfer belt 108 from the first side at the second secondary transfer portion.

When the first secondary transfer portion and the second secondary transfer portion are formed as those of the printer in the third modification, there are two possible transfers that take place at the first secondary transfer portion. The first case is that after a toner image is transferred to the front side of the transfer sheet P in FIG. 16 from the upper belt in FIG. 16, a toner image is transferred to the back side of the transfer sheet P in FIG. 16 from the lower belt in FIG. 16. The second case is opposite to the first one. For transfers to be performed at the second secondary transfer portion, similar two cases are possible. Furthermore, electrostatic pull type transfer or electrostatic push type transfer can be taken at both the first secondary transfer portion and the second secondary transfer portion. Therefore, there are eight combinations of transfer systems at both transfer portions. The present inventors tested the eight transfer systems and checked if reverse transfer of a toner image would occur at the second secondary transfer portion. The following Table 1 represents the relationship between the eight transfer systems and the presence/absence of reverse transfer at the second secondary transfer portion.

TABLE 1

| | First secondary transfer portion | | Second secondary transfer portion | | |
|---|---|---|---|---|---|
| Experiment No. | Transfer direction | Transfer type | Transfer direction | Transfer type | Reverse transfer |
| 1 | Second intermediate transfer belt → First side | Pull | First intermediate transfer belt → Second side | Pull | Bad |
| 2 | | Pull | | Push | Bad |
| 3 | | Push | | Pull | Good |
| 4 | | Push | | Push | Good |
| 5 | First intermediate transfer belt → Second side | Pull | Second intermediate transfer belt → First side | Pull | Bad |
| 6 | | Pull | | Push | Bad |
| 7 | | Push | | Pull | Good |
| 8 | | Push | | Push | Good |

Bad: Reverse transfer occurred
Good: No reverse transfer occured

As shown in Table 1, only four of the eight transfer systems, with experiment numbers 3, 4, 7 and 8, did not cause reverse transfer at the second secondary transfer portion. It is understood that all of the four transfer systems employed the electrostatic push type transfer at the second secondary transfer portion. On the other hand, with experiment numbers 1, 2, 5, and 6, where reverse transfer did occur, it is understood that all of the four transfer systems employed the electrostatic pull type transfer at the second secondary transfer portion. Accordingly, it was found that the reverse transfer occurs unless the electrostatic push type transfer was applied at the second secondary transfer portion. This is the reason why the printer in the third modification employs the electrostatic push type transfer at the second secondary-transfer portion.

As shown FIG. 11, with the white color of the transfer sheet P, four-color toner images respectively transferred to the first side and the second side at the secondary-transfer-belt abutment portion in the secondary-transfer become a full color image. The transfer sheet P having the full color image formed thereon is fed toward a fixing unit 130.

The fixing unit 130 uses fixing rollers 130*a* and 130*c* each enclosing a heat generating source as a pair of rollers that abut on each other to form a fixing nip. The fixing unit 130 heats the transfer sheet P tacked at the fixing nip from both sides, thereby fixing a full color image on the first side and a full color image on the second side. The transfer sheet P is then fed toward a pair of sheet discharge rollers 132 along a pair of reversal guides 131 and is discharged in the direction of the arrow in FIG. 11 to be stacked on a stack portion 140.

The first intermediate transfer belt 108, like the sheet feeding belt of the printer according to the embodiment, is provided at the back side with a plurality of marks and a protection layer of a transparent material that protects the marks. The second intermediate transfer belt 116 similarly includes marks and a protection layer at the back.

A first mark detection sensor 133 is disposed inside the loop of the first intermediate transfer belt 108 to detect the marks provided at the back side of the first intermediate transfer belt 108 and sends detection signals to the controller (not shown). A second mark detection sensor 134 is disposed inside the loop of the second intermediate transfer belt 116 to detect the marks provided at the back side of the second intermediate transfer belt 116 and sends detection signals to the controller (not shown). Based on the interval between the detection signals sent from the first mark detection sensor 133, the controller controls the drive speed of the second intermediate transfer belt 108 to stabilize the running speed of the first intermediate transfer belt 108. Based on the interval between the detection signals sent from the second mark detection sensor 134, the controller controls the drive speed of the second intermediate transfer belt 116 to stabilize the running speed of the second intermediate transfer belt 116.

The following will describe examples of printers having more characteristic structures added to any of the printer in the first, the second, and the third modifications. In the examples to be described below, belt members, such as the sheet feeding belt and the intermediate belt, are generically named as "belt member 200".

Figure 17:
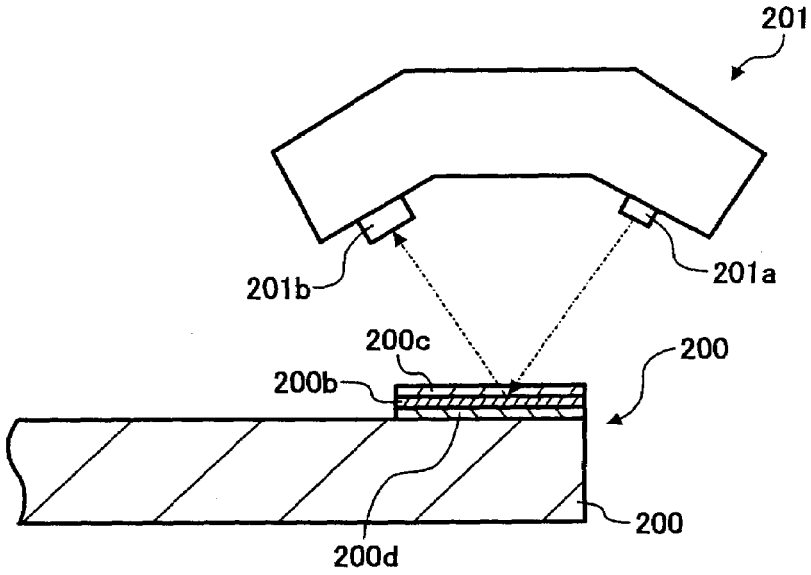
FIG. 17 is an enlarged cross-section of a belt member and a mark detection sensor in a printer according to a first embodiment of the present invention.

FIG. 17 is an enlarged cross-section of the belt member 200 and the mark detection sensor 201 in a printer according to a first embodiment of the present invention. The belt member 200 is moved in an endless-belt manner in the depth direction in FIG. 17. An intermediate layer 200*d* as an intermediate member is provided at one end portion of the back side of a belt base 200*a* of the belt member in the direction of width, and marks 200*b* and a protection layer 200*c* are laminated in order on the intermediate layer 200*d*.

Light emitted from a light emitting element 201*a* of the mark detection sensor 201 constituted by a reflective photosensor passes the protection layer 200*c* of a transparent material, and is reflected at the front sides of the marks 200*b* of aluminum or the like by a predetermined reflection angle. The reflected light is received by a light receiving element 201*b* after passing the protection layer 200*c* in the reverse direction.

It is difficult to directly fix the marks 200*b* to the back side of the belt base 200*a* depending on the combination of the material for the belt base 200*a* and the material for the marks 200*b*. When the material for the belt base 200*a* is polyimide and the material for the marks 200*b* is aluminum, particularly, both are very hard to be connected. Even if the marks 200*b* of aluminum could be fixed to the belt base 200*a* of polyimide, the marks 200*b* are separated from the belt base 200*a* relatively easily due to the poor adhesion.

Regardless of the materials, it is very difficult to directly provide plural marks 200*b*, arranged at predetermined pitches in the direction of circumference, to the back side of the belt base 200*a*. While it is relatively easy to provide a reflection layer to be the precursor of the marks at the belt base 200*a*, it is difficult to partly remove the reflection layer on the belt base to acquire a plurality of marks 200*b*. This is because it is extremely difficult to perform photolithography and etching on the back side of the belt base 200*a*. Even with the use of a method of putting stretch rollers on the belt base 200*a* reversed and partly removing the reflection layer with a laser while moving the belt base 200*a* in an endless-belt manner, it is difficult to form the marks 200*b* at accurate pitches, for front to back reversal of the belt base 200*a* causes creases on the belt base 200*a*.

In this respect, the printer according to the first embodiment has the intermediate layer 200*d* intervened between the belt base 200*a* and the marks 200*b*. According to such a structure, a material that demonstrates a good adhesion to both the belt base 200*a* and the marks 200*b* is used for the intermediate layer 200*d*, and thus the fixing property of the marks 200*b* can be improved as compared with a case that the marks 200*b* are fixed directly to the belt base 200*a*. The marks 200*b* can be provided easily at the back side of the belt base 200*a* by forming the marks 200*b* and the protection layer 200*c* on the front side of the tape-like intermediate layer 200*d* in advance.

Available materials for the intermediate layer 200*d* include polyester, nylon, and polypropylene. Polyester is particularly preferable. Preferably, the intermediate layer 200*d* has a thickness of 10 μm to 100 μm, and in particular, a thickness of 20 μm to 75 μm is suitable. When the thickness of the intermediate layer 200*c* exceeds 100 μm, the rigidity of the intermediate layer 200*c* is enhanced excessively, making it easier to separate the protection layer 200*c* from the belt base 200*a*. The shear force to the belt member 200 can be concentrated on the intermediate layer 200*c*, causing cracks. If the thickness of the intermediate layer is less than 20 μm, the work of adhering the tape-like intermediate layer 200*d* to the belt base 200*a* becomes worse or a sufficient strength cannot be acquired.

Possible examples of an adhesive for adhering the intermediate layer 200*d* or an offset stop member to be described later to the back side of the belt base 200*a* include an acrylic based adhesive, a natural-rubber based adhesive, a synthetic-rubber based adhesive, a silicone based adhesive, and a thermosetting based adhesive. The acrylic based adhesive is particularly preferable.

Figure 18:
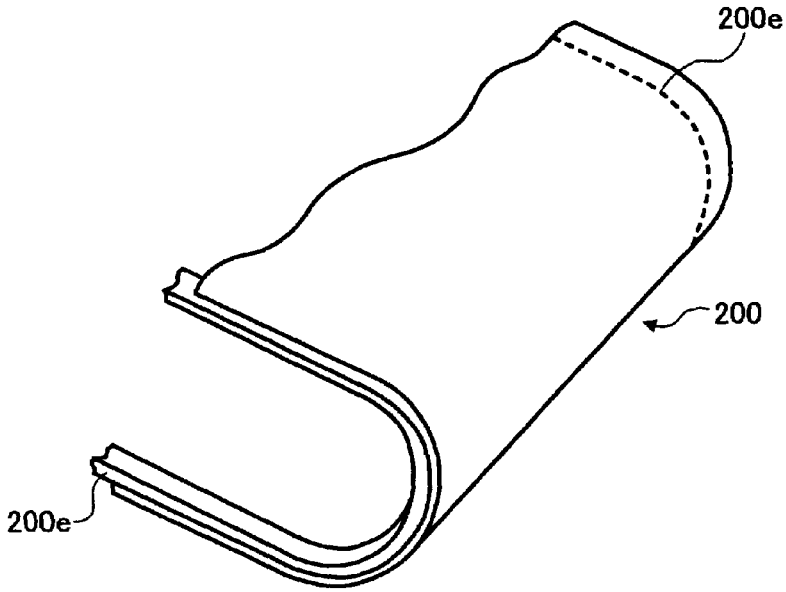
FIG. 18 is a perspective view of a belt member in a printer according to a second embodiment of the present invention.

FIG. 18 is a perspective view of the belt member 200 in a printer according to a second embodiment of the present invention. Offset stop members 200*e* protruding from the back side of the belt are provided at both ends of the belt base 200*a* of the belt member 200 in the direction of width along the perimeter in the direction of circumference. When the belt member 200 moves slightly tilted to the direction of the endless-belt movement while being stretched by a plurality of stretch rollers (not shown), the belt member 200 eventually comes off the stretch rollers. When the belt member 200 makes offset running likely to exceed the allowable amount, one of the offset stop members 200*e* at both ends in the direction of width abuts on the end face of a stretch roller (not shown), thereby inhibiting further offset running. This prevents the belt member 200 from coming off the stretch rollers.

Figure 19:
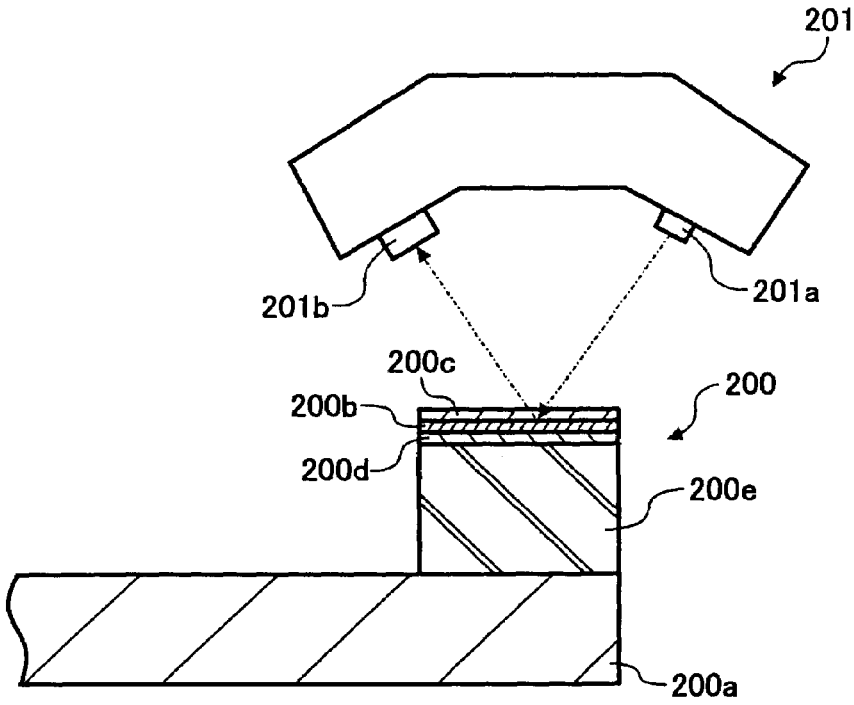
FIG. 19 is an enlarged cross-section of the belt member shown in FIG. 18 and a mark detection sensor.

FIG. 19 is an enlarged cross-section of the belt member 200 and the mark detection sensor 201 in the printer. The intermediate layer 200*d*, the marks 200*b*, and the protection layer 200*c* are laminated in order on the front side of one of the offset stop members 200*e* provided at both ends of the belt member 200. In the belt member 200 of according to the first embodiment shown in FIG. 17, a multi-layer projection including the intermediate layer 200*d*, the marks 200*b*, and the protection layer 200*c* and protruding from the back side of the belt base 200*a* contacts the stretch rollers (not shown). A foreign matter held between the stretch rollers and the protection layer 200*c* can be fixed to the protection layer 200*c*, and the foreign matter gradually stains the protection layer 200*c*. However, as shown in FIG. 19, the belt member 200 of the printer according to the second embodiment has the multi-layer projection provided on the front side of the offset stop member 200*e* that does not allow multi-layer projection to contact the stretch rollers. It is therefore, possible to prevent a foreign matter, held between the stretch rollers and the protection layer 200*c*, from being fixed to the protection layer 200*c*, which otherwise stains the protection layer 200*c*.

While the intermediate layer 200*d*, the marks 200*b*, and the protection layer 200*c* are provided at the front side of the offset stop member 200*e* in this example, only the marks 200*b* and the protection layer 200*c* can be provided, and the intermediate layer 200*d* can be omitted.

The offset stop member 200*e* can be integrally formed with, not separated from, the belt base 200*a*, as an offset preventing projection. This belt member can be manufactured by using two groove-like recesses formed in the inner surface of, for example, a cylinder provided by centrifugal molding.

An elastomer resin with a JIS-A hardness of 40 Hs to 90 Hs can be used as the material for the offset stop member 200*e*. Specific examples are polyester elastomer, polyurethane, neoprene rubber, urethane rubber, chloroprene rubber, nitrile rubber, butyl rubber, and silicone rubber. The polyurethane rubber is particularly preferable. When the hardness of the material exceeds 90 Hs, the material has good stretching and size precision, but is hard to be flexibly bent along the curved surface of a small-diameter roller, so that cracks are likely to occur. When the hardness of the material is less than 40 Hs, the offset stop member 200*e* is deformed significantly when hitting on the end face of the stretch roller with the serpentine movement of the belt member, making it difficult to sufficiently accomplish offset stop.

The preferable thickness of the offset stop member 200*e* is 0.3 mm to 1.5 mm. More preferably, the thickness is 0.5 mm to 1 mm. When the thickness exceeds 1.5 mm, the offset stop member 200*e* is hard to be bent, making it more likely to cause cracks. When the thickness is less than 0.3 mm, a sufficient offset stop effect cannot be provided.

Figure 20:
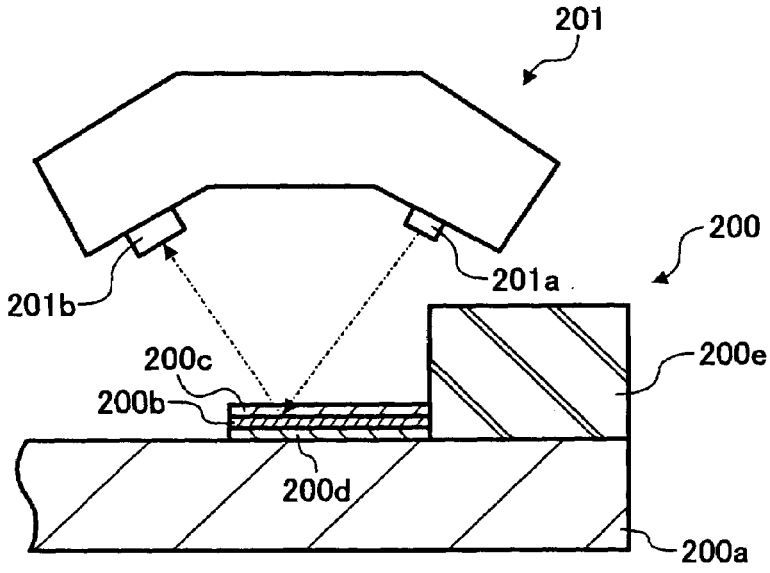
FIG. 20 is an enlarged cross-section of a belt member and a mark detection sensor in a printer according to a third embodiment of the present invention.

FIG. 20 is an enlarged cross-section of the belt member 200 and the mark detection sensor 201 in a printer according to a third embodiment. The offset stop members 200*e* are provided at both ends of the belt member 200 at the back. A three-layer projection including the intermediate layer 200*d*, the marks 200*b*, and the protection layer 200*c* is fixed to the back side of the belt base 200*a* in the vicinity of one of the offset stop members 200*e* at a position shifted from that offset stop member 200*e* toward the center in the direction of width. This is the structure shown in FIG. 19 whose three-layer projection including the intermediate layer 200*d*, the marks 200*b*, and the protection layer 200*c* is shifted from the front side of the offset stop member 200*e* to the side of the offset stop member 200*e*.

In the structure in FIG. 19 where the marks 200*b* are provided on the front side of the offset stop member 200*e*, the mark detection sensor 201 apparently protrudes from one end in a direction of width of the belt member 200. That is, there is a portion that is protruding from inside the loop of the belt member 200, and is exposed. As dust and toners are dispersed more outside the loop of the belt member 200 than inside the loop, the light emitting element 201*a* and the light receiving element 201*b* are more likely to be stained as compared with the case that they are positioned inside the loop.

According to the structure in FIG. 20 where the marks 200*b* are provided at positions shifted toward a central portion of a width of the belt from the position of the offset stop member 200*e*, on the other hand, the mark detection sensor 201 is entirely contained inside the loop of the belt member 200. This can suppress staining of the mark detection sensor 201 better than the structure shown in FIG. 19.

Figure 21:
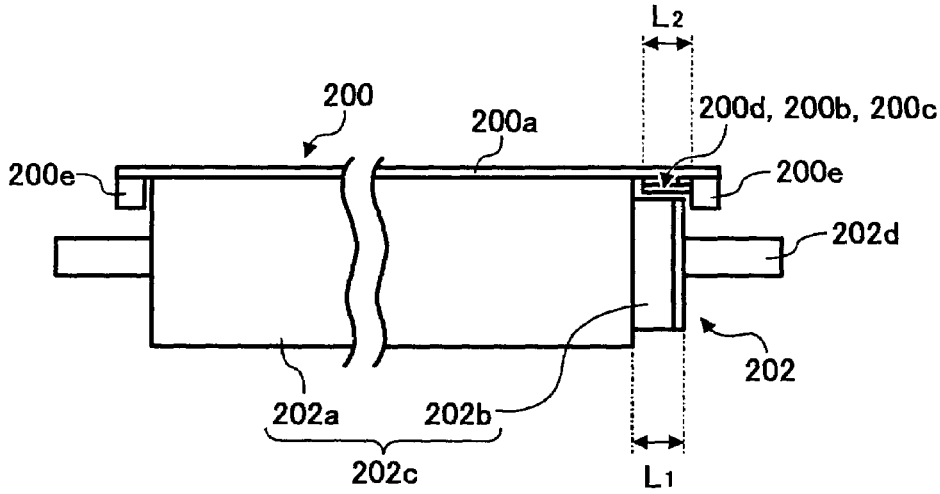
FIG. 21 is an enlarged cross-section of a belt member and a stretch roller in a printer according to a fourth embodiment of the present invention.

FIG. 21 is an enlarged cross-section of the belt member 200 and a stretch roller 202 in a printer according to a fourth embodiment. The structure of the belt member 200 is similar to that of the third embodiment shown in FIG. 20. The stretch roller 202 includes a roller portion 202*c* and a shaft member 202*d* respectively protruding from both ends in an axial direction of the roller portion 202*c*. The roller portion 202*c* includes a center roller portion 202*a* positioned at the axial center portion, and an end roller portion 202*b* coupled to that end portion of both axial ends of the center roller portion 202*a* that corresponds to the marks 200*b* of the belt member 200. The diameter of the end roller portion 202*b* is smaller than the diameter of the center roller portion 202*a*. Accordingly, a step that becomes lower toward the end portion from the center portion is formed at one end portion of the roller portion 202*c* (the end portion corresponding to the marks 200*b*). The difference between the radium of the center roller portion 202*a* and the radium of the end roller portion 202*b* is greater than the height of the three-layer projection including the intermediate layer 200*d*, the marks 200*b* and the protection layer 200*c* of the belt member 200. With the structure, a predetermined clearance is secured between the end roller portion 202*b* of the stretch roller 202 and the three-layer projection of the belt member 200 to avoid the contact of the stretch roller 202 with the protection layer 200*c*. This can prevent a foreign matter, held between the stretch rollers 202 and the protection layer 200*c*, from being fixed to the protection layer 200*c*, which otherwise stains the protection layer 200*c*.

A length L1 of the end roller portion 202*b* in the axial direction is greater than a width L2 of the three-layer projection. Even if the belt member 200 makes offset running on the leftmost side in FIG. 21 so that the end face of the end roller portion 202*b* abuts on the offset stop member 200*e* on the right-hand side in FIG. 21, therefore, the center roller portion 202*a* does not contact the three-layer projection of the belt member 200.

Figure 22:
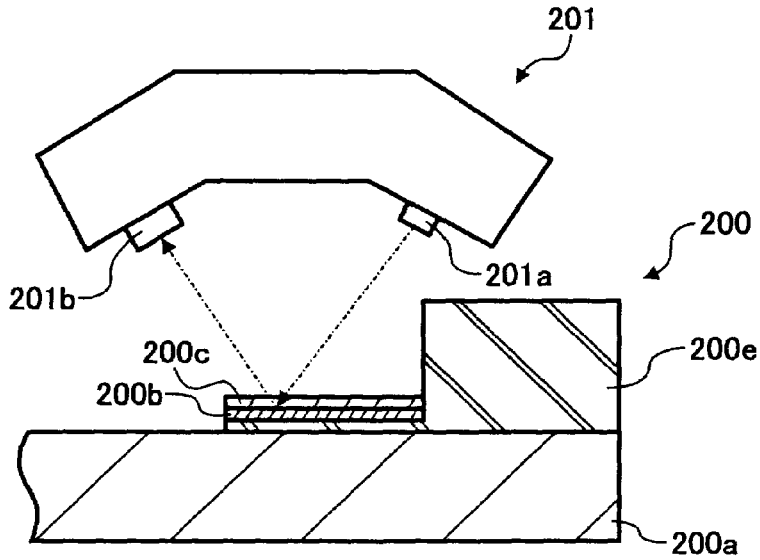
FIG. 22 is an enlarged cross-section of a belt member and a mark detection sensor in a printer according to a fifth embodiment of the present invention.

FIG. 22 is an enlarged cross-section of the belt member 200 and the mark detection sensor 201 in a printer according to a fifth embodiment. The belt member 200 has the same structure as the belt member in the third embodiment shown in FIG. 20 except for the following point. The inner side of the offset stop member 200*e* in the widthwise direction is made thinner than the outside so as to serve as an intermediate member that intervenes between the back side of the belt base 200*a* and the marks 200*b*. The intermediate member intervening between the back side of the belt base 200*a* and the marks 200*b* is integrally formed with the offset stop member. As there is no exclusive intermediate member intervening between the back side of the belt base 200*a* and the marks 200*b* in the structure, the number of parts of the belt member can be reduced as compared with the structure shown in FIG. 20.

Figure 23:
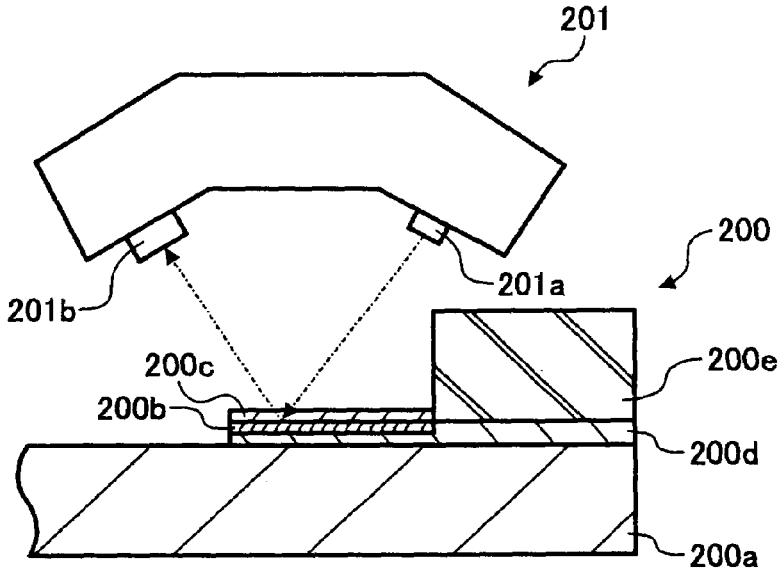
FIG. 23 is an enlarged cross-section of a belt member and a mark detection sensor in a printer according to a sixth embodiment of the present invention.
Figure 24:
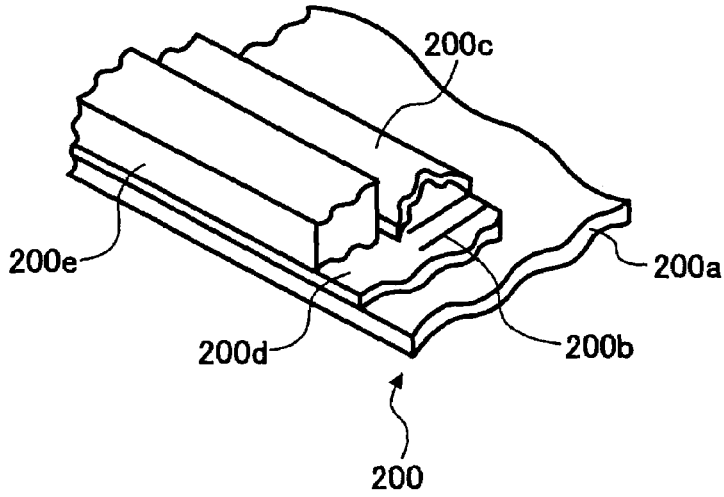
FIG. 24 is a broken view of the belt member shown in FIG. 23.

FIG. 23 is an enlarged cross-section of the belt member 200 and the mark detection sensor 201 in a printer according to a sixth embodiment. FIG. 24 is a broken view of the belt member 200. The belt member 200 has the same structure as the belt member in the third embodiment shown in FIG. 20 except for the following point. The intermediate layer 200*d* as an intermediate member that intervenes between the belt base 200*a* and the marks 200*b* is made wider than the marks 200*b* and the protection layer 200*c* so as to also intervene between the belt base 200*a* and the offset stop member 200*e*. The intermediate member intervening between the belt base 200*a* and the offset stop member 200*e* fixed to the back side of the belt base 200*a*, and the intermediate member intervening between the belt base 200*a* and the marks 200*b* are integrally formed as a single intermediate layer 200*d*. The structure brings about the following effect when a material having a relatively poor adhesion to the belt base 200*a* is used for the offset stop member 200*e* and a material having a relatively poor adhesion to the belt base 200*a* is used for the marks 200*b*. The number of parts required can be reduced as compared with a case that the intermediate member intervening between the belt base 200*a* and the offset stop member 200*e*, and the intermediate member intervening between the belt base 200*a* and the marks 200*b* are provided separately in order to improve the adhesion.

Figure 25:
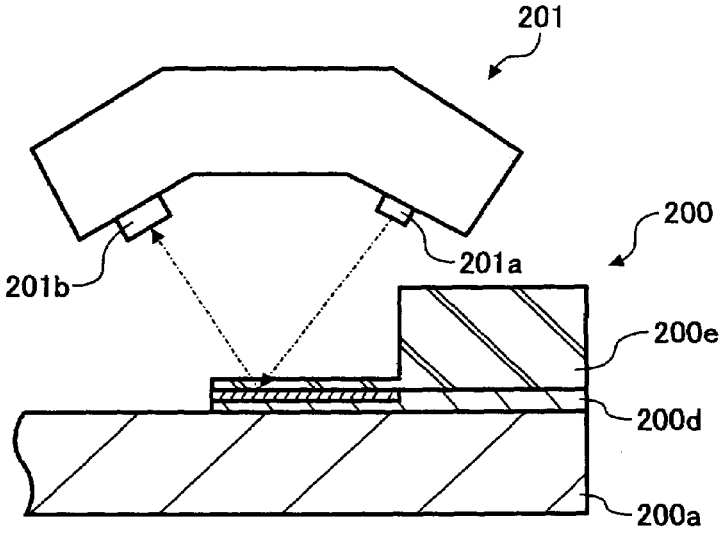
FIG. 25 is an enlarged cross-section of a belt member and a mark detection sensor in a printer according to a seventh embodiment of the present invention.

FIG. 25 is an enlarged cross-section of the belt member 200 and the mark detection sensor 201 in a printer according to a seventh embodiment. The belt member 200 has the same structure as the belt member in the sixth embodiment shown in FIG. 23 except for the following point. A transparent material having a light transmittance is used as the material for the offset stop member 200*e*, and one widthwise end of the offset stop member 200*e* is made thin and is stretched toward the belt's center to be fixed onto the marks 200*b*. That is, the offset stop member 200*e* and the protection layer for protecting the marks 200*b* are formed integrally. Since an exclusive protection layer is not required, this structure can reduce the number of required parts.

Figure 26:
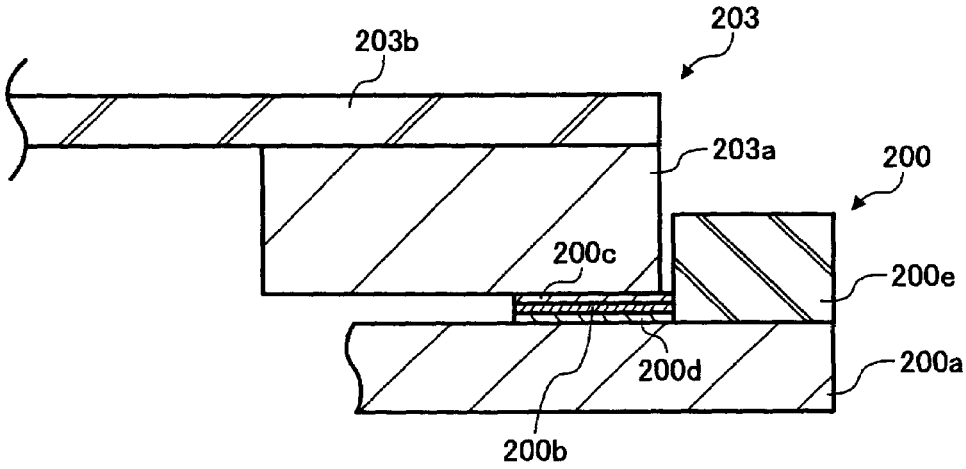
FIG. 26 is an enlarged cross-section of a belt member in a printer according to an eighth embodiment.

FIG. 26 is an enlarged cross-section of the belt member 200 in a printer according to an eighth embodiment. The belt member 200 shown in FIG. 26 has a structure similar to the structure in the third embodiment shown in FIG. 20. The printer includes a protection-layer cleaning unit 203 for cleaning the protection layer 200*c* of the belt member 200. The protection-layer cleaning unit 203 rubs a cleaning member 203*a* including a sponge or cotton or the like fixed to a fixing member 203*b* against the protection layer 200*c* of the belt member 200 that makes an endless-belt movement. The protection-layer cleaning unit 203 cleans the front side of the protection layer 200*c*. The cleaning member 203*a* can be soaked with a solvent sent from a pipe (not shown).

Figure 27:
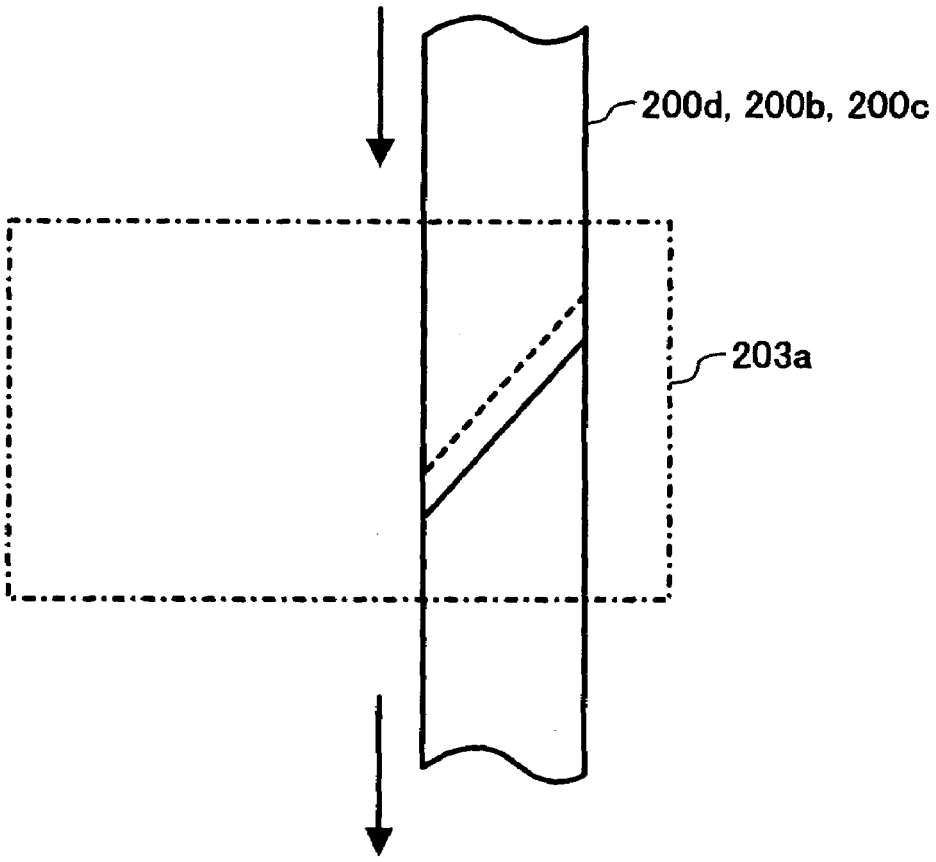
FIG. 27 is a schematic of a joint of a tape having an intermediated layer.

Tape-like materials that are not of an endless type can be used for the intermediate layer 200*d*, the marks 200*b*, and the protection layer 200*c*. Such tape-like materials can be fixed to the belt base 200*a* as follows. Both ends in a direction of length of a tape having the intermediate layer 200*d*, the marks 200*b*, or the like are cut obliquely as shown in FIG. 27 to make joints of both ends askew. Such joints can obliquely enter the abutment portion with the cleaning member 203*a*, the catching of the joints with respect to the cleaning member 203*a* can be reduced.

While the description has been given on printers that form toner images through an electrophotographic process, the present invention can be also applied to image forming apparatuses of other types, such as a direct recording type. The direct recording system directly forms a toner image on a recording medium or an intermediate recording medium without requiring a latent image carrier by directly adhering toners, jetted from a toner jetting device in the form of dots, on the recording medium or the intermediate recording medium, thereby forming a pixel image.

In the sheet feeding belt 21 of the printer according to the embodiment, the intermediate transfer belt 37 of the printer according to the first modification, the photoconductive belt 81 of the printer in the second modification, the first intermediate transfer belt 108 and the second intermediate transfer belt 116 of the printer according to the third modification, a plurality of photoreflective marks are laid out at predetermined pitches in the direction of circumference, and are all protected with the protection layer. This structure can suppress staining of all the marks with the protection layer and allow the marks to serve as means for detecting a change in the speed of the belt member.

In the belt member 200 of the printer according to the second embodiment, the offset stop members 200*e* extending in the direction of circumference are respectively provided at both ends in the direction of width of the belt base 200*a* at the back, and the marks 200*b* and the protection layer 200*c* are provided on the front side of the offset stop member 200*e*. In this structure, it is possible to prevent a foreign matter, which is held between the stretch rollers and the protection layer 200*c*, from being fixed to the protection layer 200*c*, thereby preventing the protection layer 200*c* from getting stains.

In the belt member 200 of the printer according to the third to eighth embodiments, the offset stop members 200*e* extending in the direction of circumference are respectively provided at both ends in the direction of width of the belt base 200*a* at the back, and the marks 200*b* and the protection layer 200*c* are provided at the back of the belt base 200*a* at locations shifted toward the center in the direction of width from the offset stop members 200*e*. In this structure, it is possible to place an entire body of the mark detection sensor 201 inside the loop of the belt member 200, thereby suppressing stains on the mark detection sensor 201.

In the belt member 200 of the printer according to the seventh embodiment, the offset stop members 200*e* and the protection layer are integrally formed with the same material, thereby reducing the number of required parts compared to a case in which the offset stop members 200*e* and the protection layer are formed separately.

In the belt member 200 of the printer according to the sixth embodiment, the offset stop member 200*e* formed separately from the belt base 200*a* is used as an offset stop projection, and the intermediate layer 200*d* as an intermediate member is provided between the belt base 200*a* and the offset stop member 200*e* fixed to the back side of the belt base 200*a*. With the structure, even when a material that is hard to be fixed to the belt base 200*a* is used for the offset stop member 200*e*, it is possible to fix the offset stop member 200*e* to the belt base 200*a* well by the intermediate layer 200*d*.

In the belt member 200 of the printer according to the second to eighth embodiments, the intermediate layer 200*d* as an intermediate member is provided between the belt base 200*a* and the marks 200*b* fixed to the back side of the belt base 200*a*. With the structure, even when a material that is hard to be fixed to the belt base 200*a* is used for the marks 200*b*, it is possible to fix the marks 200*b* to the belt base 200*a* by the intermediate layer 200*d*.

In the belt member 200 of the printer according to the sixth embodiment, the offset stop member 200*e* is formed separately from the belt base 200*a*, and the intermediate layer 200*d* as an intermediate member is provided between the belt base 200*a* and the offset stop member 200*e* fixed to the back side of the belt base 200*a*, and the intermediate layer 200*d* and an intermediate member to be provided between the belt base 200*a* and the marks 200*b* are integrally formed. With the structure, the number of required parts can be reduced compared to a case in which the intermediate layer 200*d* and the intermediate member are formed as separate intermediate members.

As the belt driving unit of the printer according to the eighth embodiment is provided with the protection-layer cleaning unit 203 that cleans the front side of the protection layer 200*c* of the belt member 200, it is possible to surely suppress degrading of the mark detection precision originated from stains on the protection layer 200*c*.

In the transfer unit 20 as the belt driving unit of the printer according to the embodiments, the mark detection unit is the mark detection sensor 33 that detects the mark 21*b* by receiving, with the light receiving element 33*b* as the light receiving unit, a reflected light, which is emitted from the light emitting element 33*a* as the light emitting unit and then reflected at the front side of the mark 21*b*. The mark detection sensor 33 detects the marks 21*b* on the sheet feeding belt 21 as the belt member, which are located below the mark detection sensor 33. Because of the reason mentioned above, this structure can suppress degrading of the mark detection precision originated from stains on the light emitting element 33*a* and the light receiving element 33*b* by setting the elements 33*a* and 33*b* so as to face downward, compared to a case in which the elements 33*a* and 33*b* are set facing upward.

In the printer according to each of the embodiments or the printer according to each of the modifications, stretch rollers are used as stretch members that stretch the belt member. Front sides of the stretch rollers are rotated collaterally with the circulation of the belt member. With the structure, the slide friction between the stretch members and the protection layer is smaller compared to the case in which stretch members of which front sides slide against the back side of the belt member are used. This can suppress damage of the protection layer more reliably.

In the belt driving unit of the printer according to the fourth embodiment, the stretch roller 202 includes the roller portion 202*c* and the shaft members 202*d* as shaft portions respectively protruding from both axial ends of the roller portion 202*c*, and at least one of the axial ends is the end roller portion 202*b* that is smaller in diameter than the center roller portion 202*a* as the center portion. This structure avoids the contact of the stretch roller 202 with the protection layer 200*c* provided at a position closer to the center in the direction of width than the offset stop member 200*e*. This can prevent a foreign matter, which is held between the stretch roller 202 and the protection layer 200*c* from being fixed to the protection layer 200*c*, thereby preventing stains, which are caused due to the foreign matter, on the protection layer 200*c*.

The printer according to the embodiments, or the printer according to the first modification and the third modification includes a photosensitive element as a latent holding member that carries a latent image, and a developing device as the developing unit to develop the latent image on the photosensitive element, and uses an annular belt member (21, 37, 108, 116) that is moved in such a manner that the annular belt member makes endless circulation and passes the position facing the photosensitive element. The printer further includes a, transfer unit (20, 115, 125) that transfers a toner image, which is developed by the developing device, to the belt member from the front side of the photosensitive element at the position at which the belt member faces the photosensitive element. The structure can restrain a transfer position shift originated from a change in the speed of the belt member and friction of the toner image by stabilizing the running speed of the belt member by suppressing degrading of the mark detection precision with the protection layer.

The printer according to the embodiments includes the visible image forming unit that forms a toner image on the transfer sheet P as a recording medium in a form of sheet, and the transfer unit 20 as the belt driving unit that feeds the transfer sheet P undergoing the formation of a toner image with the endless-belt movement of the sheet feeding belt 21 while holding the transfer sheet P on the front side of the sheet feeding belt 21 as the annular belt member. With the structure, it is possible to feed the transfer sheet P at a more stable speed by stabilizing the running speed of the sheet feeding belt 21 by suppressing degrading of the mark detection precision with the protection layer.

The printer according to the second modification includes the photosensitive element unit 80 as the belt driving unit to move the photoconductive belt 81 as an annular latent image carrying belt, which carries a latent image, in an endless-belt manner, the developing unit 70 as the developing unit to develop the latent image on the photoconductive belt 81, and the transfer unit 20 as the transfer unit to transfer a toner image, developed on the photoconductive belt 81, to the transfer sheet P. With the structure, it is possible to suppress disturbance of a toner image originated from a change in the speed of the photoconductive belt 81 at the optical writing position by stabilizing the running speed of the photoconductive belt 81 by suppressing degrading of the mark detection precision with the protection layer. The intermediate layer, the protection layer, and the mark member at the belt base can serve as reinforcing members that restrain cracks at the end portions of the belt member.

According to the present invention, it is possible to suppress degrading of the mark detection precision.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A belt member that is formed in an annular shape that enables endless circulation of the belt member, comprising:

a belt base;

a mark that is formed with a light reflective material; and a protection layer that is formed with a translucent material, wherein the protection layer covers the mark, and the mark and the protection layer are arranged on a surface of the belt member, the surface on an inner side of the annular shape.

2. The belt member according to claim 1, wherein the mark is provided in a plurality, and marks are arranged at predetermined intervals in a direction of circulation of the belt member, and are protected with the protection layer.

3. The belt member according to claim 1, further comprising an offset stop projection that extends in the direction of the circulation of the belt member, wherein the offset stop projection is provided on the surface at each end of the belt member in a direction of a belt width, and the mark and the protection layer are provided on a surface of each of the offset stop projections.

4. The belt member according to claim 1, further comprising an offset stop projection that extends in the direction of the circulation of the belt member, wherein the offset stop projection is provided on the surface at each end of the belt member in a direction of a belt width, and the mark and the protection layer are provided at a position that is shifted from each of the offset stop projections toward a center of a belt width.

5. The belt member according to claim 4, wherein the offset stop projection and the protection layer are integrally formed with an identical material.

6. The belt member according to claim 3, further comprising an intermediate member, wherein the offset stop projection is an offset stop member that is formed independently from the belt base, and the intermediate member is provided between the belt base and the offset stop member.

7. The belt member according to claim 4, further comprising an intermediate member, wherein the offset stop projection is an offset stop member that is formed independently from the belt base, and the intermediate member is provided between the belt base and the offset stop member.

8. The belt member according to claim 1, further comprising a first intermediate member, wherein the first intermediate member is provided between the belt base and the mark.

9. The belt member according to claim 8, further comprising a second intermediate member, wherein the offset stop projection is an offset stop member that is formed independently from the belt base, the second intermediate member is provided between the belt base and the offset stop member, and the first intermediate member and the second intermediate member are integrally formed.

10. A belt driving unit comprising:

a belt member that is formed in an annular shape, which enables endless circulation of the belt member, and that includes:

a plurality of marks that are formed with a light reflective material; and a plurality of protection layers that are formed with a translucent material, wherein each of the marks is covered by one of the protection layers, and the marks and the protection layer are arranged on a surface of the belt member, the surface on an inner side of the annular shape;

a plurality of stretch members that stretch the belt member while supporting the belt member from the inner side;

a driving unit that drives the belt member to make the endless circulation with drive power of a drive source;

a detection unit that detects the marks; and a control unit that controls driving of the drive source based on a result of detection by the detection unit.

11. The belt driving unit according to claim 10, further comprising a cleaning unit that cleans the protection layer.

12. The belt driving unit according to claim 10, wherein the detection unit detects the marks by a mechanism in which a light receiving unit receives a reflected light that is a light reflected by the marks, the light emitted from a light emitting unit, and the detection unit detects the marks of a belt unit that is located below the mark detection unit.

13. The belt driving unit according to claim 10, wherein the belt member further includes an offset stop projection that extends in the direction of the circulation, the offset stop projection provided on the surface at each end of the belt member in a direction of a belt width, the mark and the protection layer are provided at a position that is shifted from each of the offset stop projections toward a center of a belt width, and the stretch members are stretch rollers.

14. The belt driving unit according to claim 13, wherein each of the stretch rollers includes:

a roller; and a shaft that protrudes from both ends of the roller, and at least one of the ends has a diameter smaller than a diameter of a central portion of the roller.

15. An image forming apparatus comprising:

a latent image carrier that carries a latent image;

a developing unit that develops the latent image into a visible image;

a belt driving unit that includes:

a belt member that is formed in an annular shape, which enables endless circulation of the belt member, which is arranged in such a manner that the belt member makes a contact with the latent image carrier, and that includes:

a plurality of marks that are formed with a light reflective material; and a plurality of protection layers that are formed with a translucent material, wherein each of the marks is covered by one of the protection layers, and the marks and the protection layer are arranged on a surface of the belt member, the surface on an inner side of the annular shape;

a plurality of stretch members that stretch the belt member while supporting the belt member from the inner side;

a driving unit that drives the belt member to make the endless circulation with drive power of a drive source;

a detection unit that detects the marks; and a control unit that controls driving of the drive source based on a result of detection by the detection unit, and a transfer unit that transfers the visible image from the latent image carrier to the belt member at a position at which the latent image carrier and the belt member contact with each other.

16. An image forming apparatus comprising:

a visible-image forming unit that forms a visible image on a recording medium that is formed in a sheet; and a belt driving unit that conveys the recording medium, and that includes:

a belt member that is formed in an annular shape, which enables endless circulation of the belt member, which is arranged in such a manner that the belt member makes a contact with the latent image carrier, and that includes:

a plurality of marks that are formed with a light reflective material; and a plurality of protection layers that are formed with a translucent material, wherein each of the marks is covered by one of the protection layers, and the marks and the protection layer are arranged on a surface of the belt member, the surface on an inner side of the annular shape;

a plurality of stretch members that stretch the belt member while supporting the belt member from the inner side;

a driving unit that drives the belt member to make the endless circulation with drive power of a drive source;

a detection unit that detects the marks; and a control unit that controls driving of the drive source based on a result of detection by the detection unit, wherein the belt driving unit conveys the recording medium by the endless circulation while holding the recording medium on a surface on an outer side of the annular shape of the belt member.

17. An image forming apparatus comprising:

a latent image carrier that is an annular belt, and that carries a latent image;

a belt driving unit that drives the latent image carrier to make an endless circulation and that includes:

a belt member that is formed in an annular shape, which enables endless circulation of the belt member, which is arranged in such a manner that the belt member makes a contact with the latent image carrier, and that includes:

a plurality of marks that are formed with a light reflective material; and a plurality of protection layers that are formed with a translucent material, wherein each of the marks is covered by one of the protection layers, and the marks and the protection layer are arranged on a surface of the belt member, the surface on an inner side of the annular shape;

a plurality of stretch members that stretch the belt member while supporting the belt member from the inner side;

a driving unit that drives the belt member to make the endless circulation with drive power of a drive source;

a detection unit that detects the marks; and a control unit that controls driving of the drive source based on a result of detection by the detection unit;

a developing unit that develops the latent image into an visible image; and a transfer unit that transfers the visible image to a recording medium.

* * * * *